US011835239B2

(12) United States Patent
Hoerter

(10) Patent No.: US 11,835,239 B2
(45) **Date of Patent: *Dec. 5, 2023**

(54) PROCESS AND APPARATUS FOR COOKING UTILIZING NEBULIZED WATER PARTICLES AND AIR

(71) Applicant: AHA, LLC, Bloomfield, IN (US)

(72) Inventor: Robert Hoerter, Bloomfield, IN (US)

(73) Assignee: AHA, LLC, Bloomfield, IN (US)

( * ) Notice: Subject to any disclaimer, the term of this patent is extended or adjusted under 35 U.S.C. 154(b) by 470 days.

This patent is subject to a terminal disclaimer.

(21) Appl. No.: 17/222,133

(22) Filed: Apr. 5, 2021

(65) Prior Publication Data

US 2021/0222890 A1 Jul. 22, 2021

Related U.S. Application Data

(63) Continuation-in-part of application No. 16/367,854, filed on Mar. 28, 2019, now Pat. No. 10,966,432.

(Continued)

(51) Int. Cl.
*F24C 15/32* (2006.01)
*F24C 15/00* (2006.01)

(Continued)

(52) U.S. Cl.
CPC ..... *F24C 15/327* (2013.01); *F24C 7/006* (2013.01); *F24C 13/00* (2013.01); *F24C 15/003* (2013.01); *F24C 15/325* (2013.01); *F24C 15/006* (2013.01)

(58) Field of Classification Search
CPC . A21B 1/36; A21B 3/04; F24C 15/003; F24C 13/00; F24C 15/327; A47J 27/04; A47J 2027/043
See application file for complete search history.

(56) References Cited

U.S. PATENT DOCUMENTS 2,141,591 A 12/1938 Bonner
4,700,685 A * 10/1987 Miller ..... F24C 15/327 219/400

(Continued)

FOREIGN PATENT DOCUMENTS

JP H0799909 A 4/1995
KR 100665714 B1 1/2007

OTHER PUBLICATIONS

International Preliminary Report on Patentability and Written Opinion of the International Searching Authority issued by the International Searching Authority dated Sep. 28, 2021 with respect to PCT/US2020/023118 in relation to U.S. Appl. No. 16/367,854, parent application of the current application.

*Primary Examiner* — David J Laux
(74) *Attorney, Agent, or Firm* — Scott R. Cox; Jessica C. Ronald

(57) ABSTRACT

A process and apparatus for heating, cooling or heating and cooling multiple chambers of a food preparation device utilizing heated and/or cooled nebulized water particles and heated and/or cooled compressed air. The steps of heating include heating water contained in reservoir located outside of the cooking chambers, heating compressed air, conveying the heated water and the heated compressed air to at least one nebulizer, nebulizing the heated water into heated water particles and introducing the heated water particles into the cooking chamber via the heated compressed air. The steps of cooling include cooling water contained in an additional reservoir located outside of the cooking chambers, cooling compressed air, conveying the cooled water and the cooled compressed air to at least one nebulizer, nebulizing the cooled water into cooled water particles and introducing the cooled water particles into the cooking chamber via the cooled compressed air.

20 Claims, 16 Drawing Sheets

Related U.S. Application Data

(60) Provisional application No. 62/649,677, filed on Mar. 29, 2018.

(51) Int. Cl.
*F24C 7/00* (2006.01)
*F24C 13/00* (2006.01)

(56) References Cited

U.S. PATENT DOCUMENTS 4,906,485 A 3/1990 Kirchhoff
5,494,690 A * 2/1996 Shelton ..... G05D 23/1931 426/520
5,530,223 A * 6/1996 Culzoni ..... A21B 3/04 239/509
5,619,983 A * 4/1997 Smith ..... F24C 15/327 126/369
6,188,045 B1 * 2/2001 Hansen ..... F22B 27/16 219/400
7,304,278 B2 * 12/2007 Kanzaki ..... F24C 15/327 219/403
7,867,534 B2 * 1/2011 Sells ..... F24C 15/327 126/369
7,989,737 B2 * 8/2011 Jeon ..... F22B 1/288 219/401
8,993,934 B2 * 3/2015 Giazzon ..... F24C 15/327 219/400
2008/0078371 A1 * 4/2008 Boscaino ..... F24C 15/327 126/20
2013/0259455 A1 * 10/2013 Schootstra ..... F22B 1/287 392/394
2013/0264327 A1 * 10/2013 Kao ..... F24C 7/06 219/401
2017/0082301 A1 * 3/2017 Tommasin ..... F28D 21/0014
2020/0329909 A1 * 10/2020 Conrad ..... F24C 7/08

* cited by examiner

PROCESS AND APPARATUS FOR COOKING UTILIZING NEBULIZED WATER PARTICLES AND AIR

CROSS-REFERENCE TO RELATED APPLICATION

This application is a continuation-in-part application of U.S. Ser. No. 16/367,854, filed on Mar. 28, 2019 (for which a Notice of Allowance was issued on Dec. 8, 2020), which claims the benefit of provisional Application No. 62/649,677, filed on Mar. 29, 2018. The entire contents of the above applications are incorporated herein by reference.

FIELD OF THE INVENTION

The field of food preparation devices, and more particularly, to a food preparation device utilizing nebulized water particles and air to cook and/or cool food or hold food at a desired end temperature in multiple chambers of the device.

BACKGROUND

Numerous preparation devices and procedures are known for the preparation of foods including several types of ovens and similar equipment. One example of a known preparation device is a dry heat oven, as disclosed in U.S. Pat. No. 2,931,882. Although commonly used, there are many problems associated with the use of dry heat ovens. For example, the cooked food usually has a deteriorated appearance, loss of nutritional elements and vitamins, and substantial shrinkage due to the significant loss of water content that occurs with heating the food with dry heat. Accordingly, dry heat ovens are not efficient because excess heat is needed to compensate for the necessary and substantial loss of moisture from the food.

Another well-known food preparation device and procedure includes water vapor ovens, as shown in U.S. Pat. No. 5,494,690. However, there are also many problems associated with the use of water vapor ovens. For example, the large volume of water used during the cooking cycle often becomes contaminated with albumin, fat and other effluents that exude from the food as it is cooked. As a result, a large volume of contaminated water must be drained from the bottom of the unit.

A further, additional food preparation device and procedure includes an automated steam generating system that introduces steam into the cooking cavity of the oven, such as disclosed in U.S. Pat. Nos. 8,704,138 and 7,867,534. However, there are drawbacks with steam ovens. For example, these ovens create a "sweat" due to the condensation of the steam meeting the cooler surfaces of the interior oven walls. This "sweat" often collects, pools and runs over the sides of cooking pans, resulting in a hard to clean food film on the oven's interior surface. Furthermore, the high steam temperatures have a greatly deleterious effect on the nutritional value of foods cooked and are inherently dangerous as scalding and burning is necessarily imparted upon the users by water vapor heated above 212 degrees Fahrenheit.

The inventors have discovered a solution to the problems associated with previous oven systems by inventing an oven that harnesses the precision generation of water vapor and high velocity air. The inventors have discovered a process that uses a surprisingly small amount of water to cook or cool the food, so the delivery of water vapor is more precise, and the oven is more energy efficient. Accordingly, the inventors have discovered a process of cooking food that does not create "drips" or "puddles" of water on the oven walls or floor due to the condensation of excess steam. Further, the inventors have discovered a way to utilize water vapor that is held at a temperature below 212 degrees Fahrenheit, so the oven is safer, more user friendly, and the food retains its taste and nutritional value.

SUMMARY OF INVENTION

One embodiment includes a process for heating an oven, that complies with all U.S. FDA food safety guidelines, wherein the process includes heating water that is contained in a reservoir located outside of a cooking chamber of the oven to reach a desired end point temperature that is less than boiling, heating compressed air through an air heater that is submerged within the water of the reservoir, conveying the heated water and the heated compressed air to a nebulizer, nebulizing the heated water into heated water particles, and introducing the heated water particles into the cooking chamber via the heated compressed air.

This embodiment includes a cooking chamber located within the oven, a nebulizer attached to the cooking chamber, a reservoir of water located outside of the cooking chamber, wherein the reservoir of water includes an air heater submerged within the water of the reservoir, wherein the air heater includes a first end that connects to an air compressor and a second end that connects to the nebulizer, a first water heater including a first and second ends thereof, wherein the first and second ends of the first water heater are submerged within the water of the reservoir, and a pipeline including a pump, wherein one end of the pipeline is submerged within the water of the reservoir and an opposite end of the pipeline connects to the nebulizer.

Another embodiment includes a process of chilling, cooling or refrigerating an oven, wherein the method includes chilling water contained in a reservoir that is located outside of a cooking chamber of the oven to reach a desired end point temperature that is between about 30 degrees Fahrenheit and 50 degrees Fahrenheit, chilling compressed air through an air chiller that is submerged within the water of the reservoir, conveying the chilled water and the chilled compressed air to a nebulizer, nebulizing the chilled water into chilled water particles, and introducing the chilled water particles into the cooking chamber via the chilled compressed air.

Another embodiment includes heating and cooling water and compressed air to a desired end point temperature, nebulizing the heated and cooled water into heated and cooled water particles and introducing the heated and cooled water particles into a single chamber or multiple chambers of a food preparation device via the heated and cooled compressed air.

BRIEF DESCRIPTION OF THE DRAWINGS

FIG. 12 is a schematic diagram of a food preparation device containing four chambers.

DETAILED DESCRIPTION OF ONE EMBODIMENT OF THE INVENTION

Figure 1:
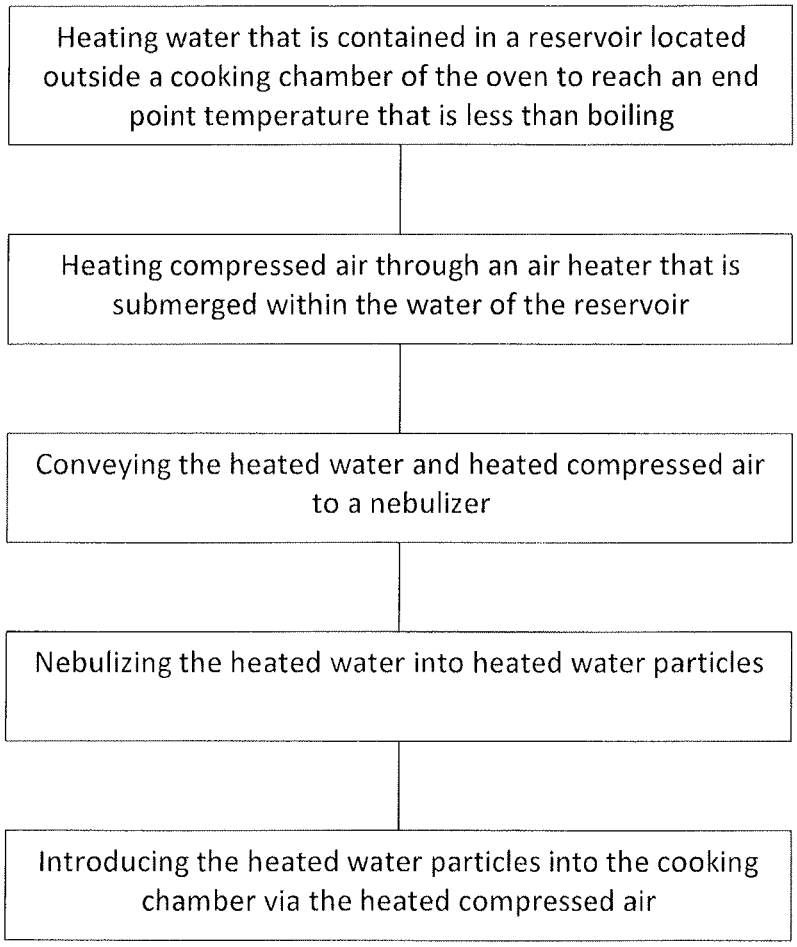
FIG. 1 is a schematic diagram of a process of heating an oven for cooking using nebulized water particles and compressed air.
Figure 2:
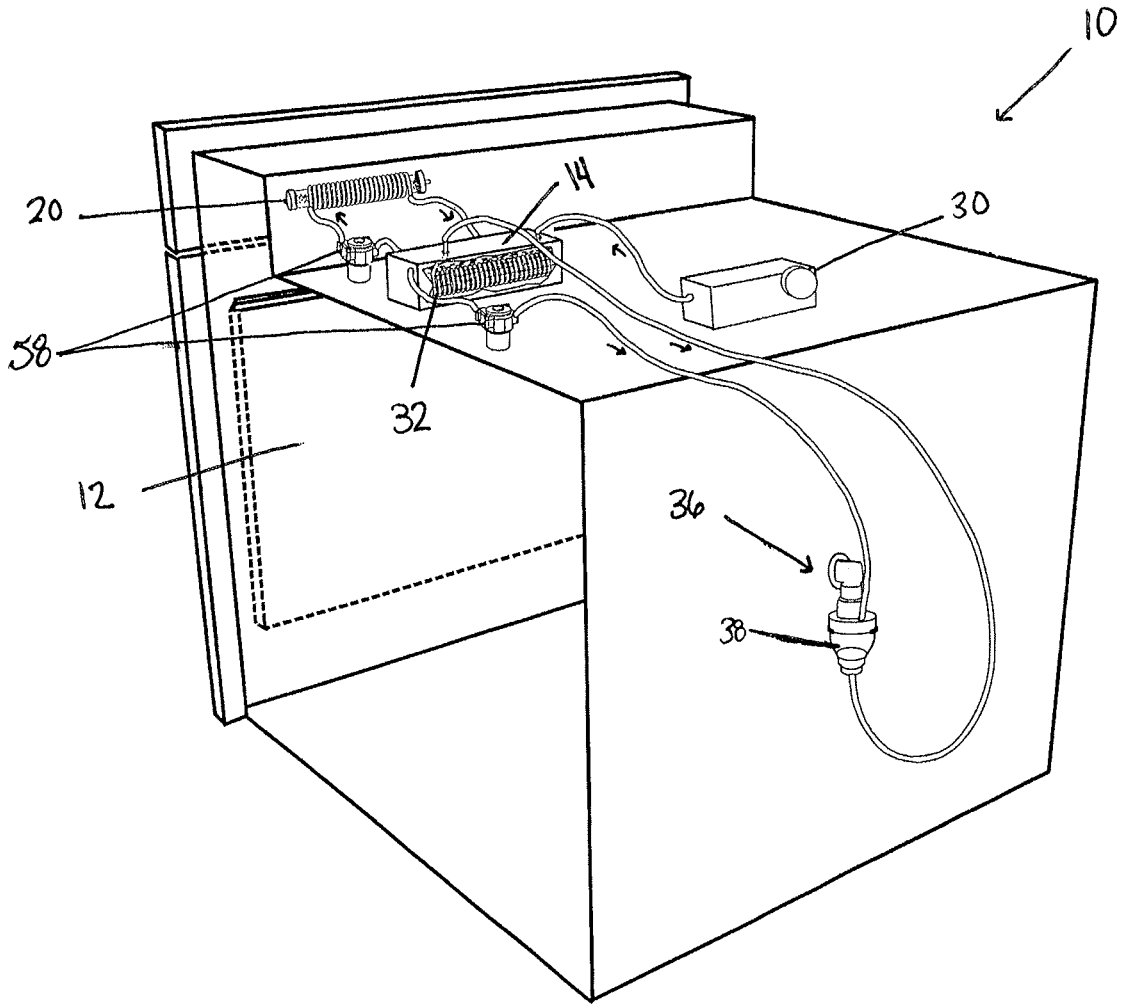
FIG. 2 shows an oven for cooking using nebulized water particles including a reservoir of water with an air heater coil submerged therein, a water heater coil, an air compressor, and a nebulizer.

FIG. 1 is a schematic diagram of one embodiment of a process of heating an oven or food preparation device (10) for cooking using nebulized water particles and compressed air, as shown in FIG. 2. The word, "oven" used herein should not be construed as limiting the device itself or the ways in which the device is used. For example, the device is not limited to ovens, but may include a food display case, a holding cabinet, or a dough proofer or any other food preparation device. The oven is also referred to herein as a "food preparation device", which language should also not be construed as limiting the device itself or the ways in which the device is used. In this embodiment the method includes heating a reservoir (14) of water that is located outside of a cooking chamber (12), as shown in FIG. 2. The reservoir of water is heated by pumping water that is present within the reservoir out of the reservoir and through a water heater coil (20). The pumps utilized to pump water throughout the oven system can be any form of water pump, preferably a peristaltic pump, as these pumps are small, precise and simple. Additionally, when a peristaltic pump is switched off, the pump acts as a closed valve, eliminating cross contamination and back pressure. Further, these water pumps move the unpressurized water to and/or from the heaters, reservoir(s), nebulizer(s) and condenser circuits. These pumps are arranged throughout the oven system to efficiently pump the water.

Figure 3:
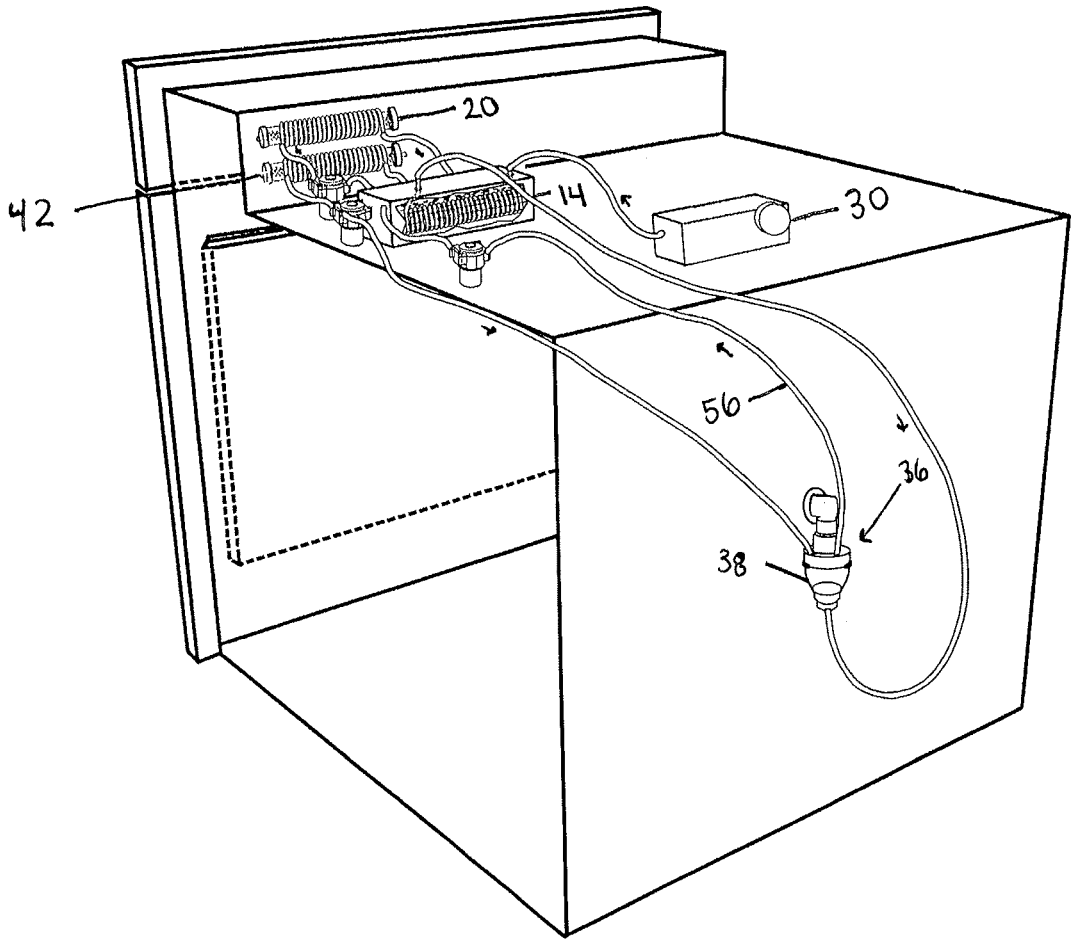
FIG. 3 shows a second embodiment of the oven of FIG. 2 with an additional water heater coil present between the reservoir and nebulizer.
Figure 4:
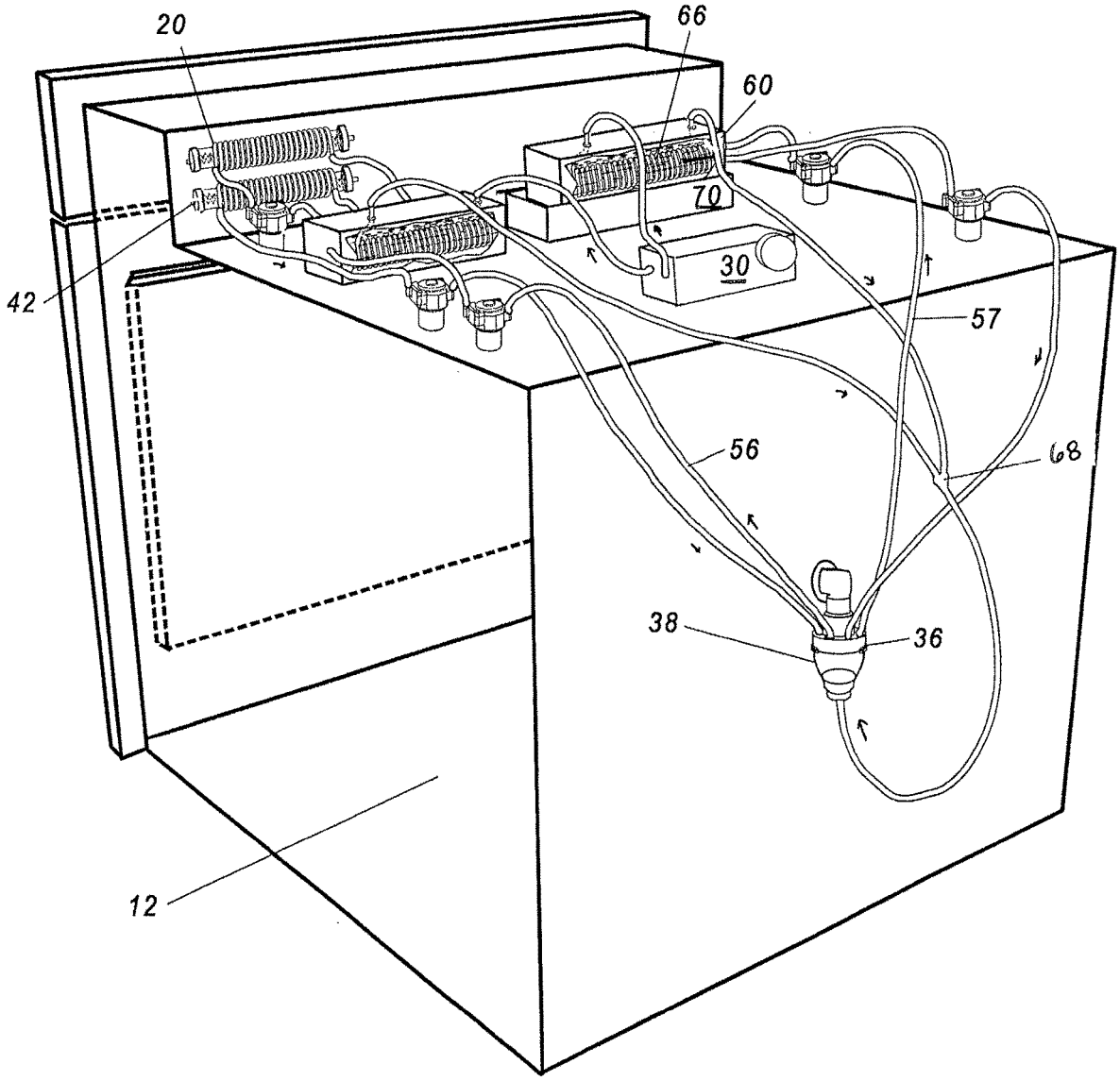
FIG. 4 shows a third embodiment of the oven of FIG. 2 for cooking and/or cooling using nebulized water particles and compressed air with a cooled air and water component.
Figure 5:
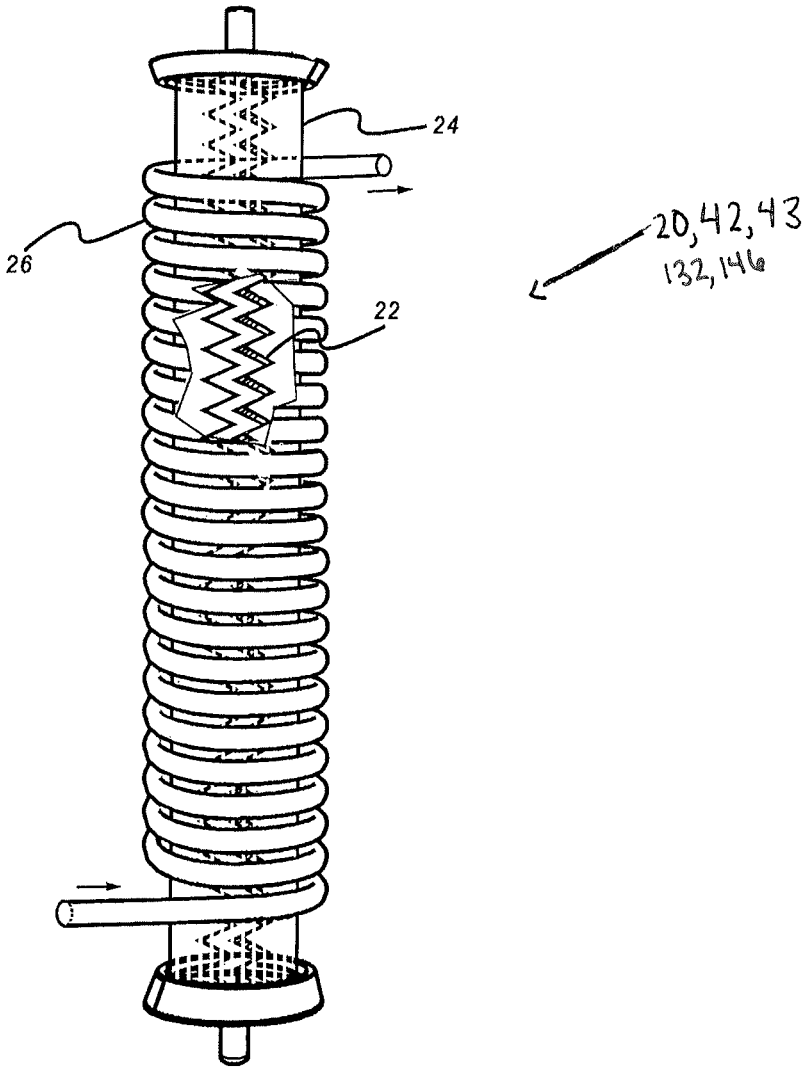
FIG. 5 is a front view of the water heater coil in accordance with the oven of FIG. 2.

In this embodiment, the water heater is a water heater coil (20), as shown in FIGS. 2, 3, 4, 7, 12-14, and specifically in FIG. 5 includes a resistance wire (22), such as a copper wire or coiled nichrome wire, that passes through glass ceramic tubing (24), which resistance wire and glass ceramic tubing are further surrounded by coiled copper tubing (26). Advantageously, the coiled nichrome wire can be precisely calibrated to the exact desired temperature range by controlling both the diameter and total length of the wire.

This process of heating the water is advantageous because the rapid heating of the nichrome wire and glass-ceramic tubing, in combination with the excellent heat conductivity of copper, almost instantaneously heats the small amount of water necessary for the oven to operate. Thus, the water is quickly heated to the desired end temperature resulting in a vastly more efficient oven and cooking process.

A further embodiment of the water heater includes a halogen light bulb to heat the water or a length of a kanthal sheathed in the ceramic glass tubing. The novel arrangement of the water heater coil avoids the use of a cal-rod or cal-rods to heat large volumes of water, which, as demonstrated by prior art, is too slow and overshoots the target temperature, thus overcooking the food. Further, the oven (10) also has a much faster temperature and vapor recovery rate, for instance, when the oven door is opened because the oven is continuously creating water vapor heated at the desired temperature and continuously introducing this into the cooking chamber under pressure.

The process of heating the water within the reservoir (14) repeats until the water reaches a desired end point temperature that is less than boiling. This desired end point temperature is determined by a user of the oven (10) when he manually enters the desired end temperature or selects a predetermined cooking program. For example, multiple valves, such as solenoid valves, are present within the air and water lines of the device. These valves are advantageously small and operate in conjunction with the logistics of the oven to ensure the proper water and air lines are opened and closed based on the selection of the user. Present within the reservoir of water is a temperature probe (not shown) that senses the temperature of the water within the reservoir and relays this temperature data to a programmable logic device ("PLD"). PLDs are known electronic components used to build digital circuits that monitor, control and alter the oven's temperature. If the temperature within each feature of the oven (10) is not accurate, the individual PLDs can adjust, readjust and fine tune the temperature by a series of thermostatic controllers that monitor and alter the inputs to the respective heater circuits of the oven. For example, the reservoir temperature sensor relays data about the internal temperature within the reservoir to a reservoir PLD. If the temperature is not where it should be, the PLD automatically adjusts the temperature of a water heater coil to ensure the water temperature within the insulated reservoir is the precise temperature necessary to cook the food to the desired end temperature.

The reservoir (14) can be made of any material, but an insulated material is preferable so as to retain the temperature of the water within the reservoir more consistently. For example, the amount of water needed to cook an entire chicken to an internal temperature of 165° F. is eight fluid ounces (240 ml) of water. This advantageously makes the oven (10) more energy efficient as it does not have to continually overcompensate for lost heat in the oven system. Advantageously, the oven can run on a 120v relay, rather than a 240v relay additionally making the oven much more energy efficient than prior art ovens.

In the first embodiment shown in FIG. 2, after or as the water in the reservoir (14) is recirculating through the water heater coil (20), air is transferred through an air heater coil (32) that is submerged within the water of the reservoir. In this embodiment, the air is piped through the air heater coil, but other embodiments include alternative means of transferring the air, such as a pump. When the water in the reservoir is heated to the desired end point temperature, the air heater coil, which is made of a heat exchanging material, such as copper, necessarily heats to the specific desired end temperature of the water in the reservoir. In this embodiment, the air heater includes a coil or hollow tubing, which is beneficial as it heats the air when it run through the coil. However, the air heater can be any shape or form and made of any material. Accordingly, when air is piped through the air heater coil, the air is heated to the desired end temperature initially selected by a user of the oven.

In this embodiment, the air is initially piped from a compressor (30) that is located outside of the reservoir. Accordingly, compressed air at a preselected velocity is pumped through the air heater coil. The air compressor may, for example, be a piston air compressor which additionally sterilizes the air. A compressed air PLD controls the pressure of the air being pumped from the air compressor, through the air heater coil (32), into the nebulizer (36) and into the cooking chamber (12). The pressure of air required depends on many factors such as the volume of the cooking chamber, the relative size of the water volume being pumped throughout the oven (10) and the orifice size.

In this embodiment, once the water in the reservoir (14) reaches the desired end temperature for cooking, the water is pumped from the reservoir to a nebulizer (36), as shown in FIG. 2. The nebulizer is preferentially located on a backside of the cooking chamber (12). As this system requires little water to operate, the heated water is delivered to the nebulizer nearly instantly with precise temperature control. This is highly important in cooking food and is an advantage over prior art methods and ovens as it allows both fine control and precise, repeatable consistency in cooking the food to the desired temperature. Furthermore, the oven can be used in any area whether it be the foodservice industry or for use within a person's home.

In a second embodiment of the oven (10), as shown in FIG. 3, the heated water from the reservoir (14) is pumped through an additional water heater coil (42) on its way to the nebulizer (36). This additional water heater coil acts as a secondary heat source for the heated water to ensure that the heated water reaches the nebulizer at the desired end temperature. The second water heater coil also ensures that the heated water has not lost its temperature as a result of its movement to the nebulizer (36). The second water heater is used as a "trimming" heater, fine-tuning the temperature of the pre-heated water in the reservoir.

In the first embodiment, as shown in FIG. 2, the heated water is nebulized into heated water particles within the nebulizer (36) using conventional nebulizer techniques. The nebulizer can be any form of nebulizer, such as a Philips Respironics HS 860 SideStream® nebulizer, which are disposable and made of a plastic. These nebulizers have a unique five-hole design and a venturi port to create a stream of nebulized particles, 80% of which are less than 5 microns in size. However, the nebulizer can be made of any material.

In this embodiment, the air that has been heated to the desired end temperature from the air compressor (30) via the air heater coil (32) is piped to the nebulizer (36), as shown in FIG. 2. The heated water particles are introduced into the cooking chamber (12) of the oven via the heated compressed air that is in the nebulizer. The nebulized water particles cook the food to the desired end temperature and are continually introduced into the cooking chamber (12) via the heated compressed air.

Figure 6:
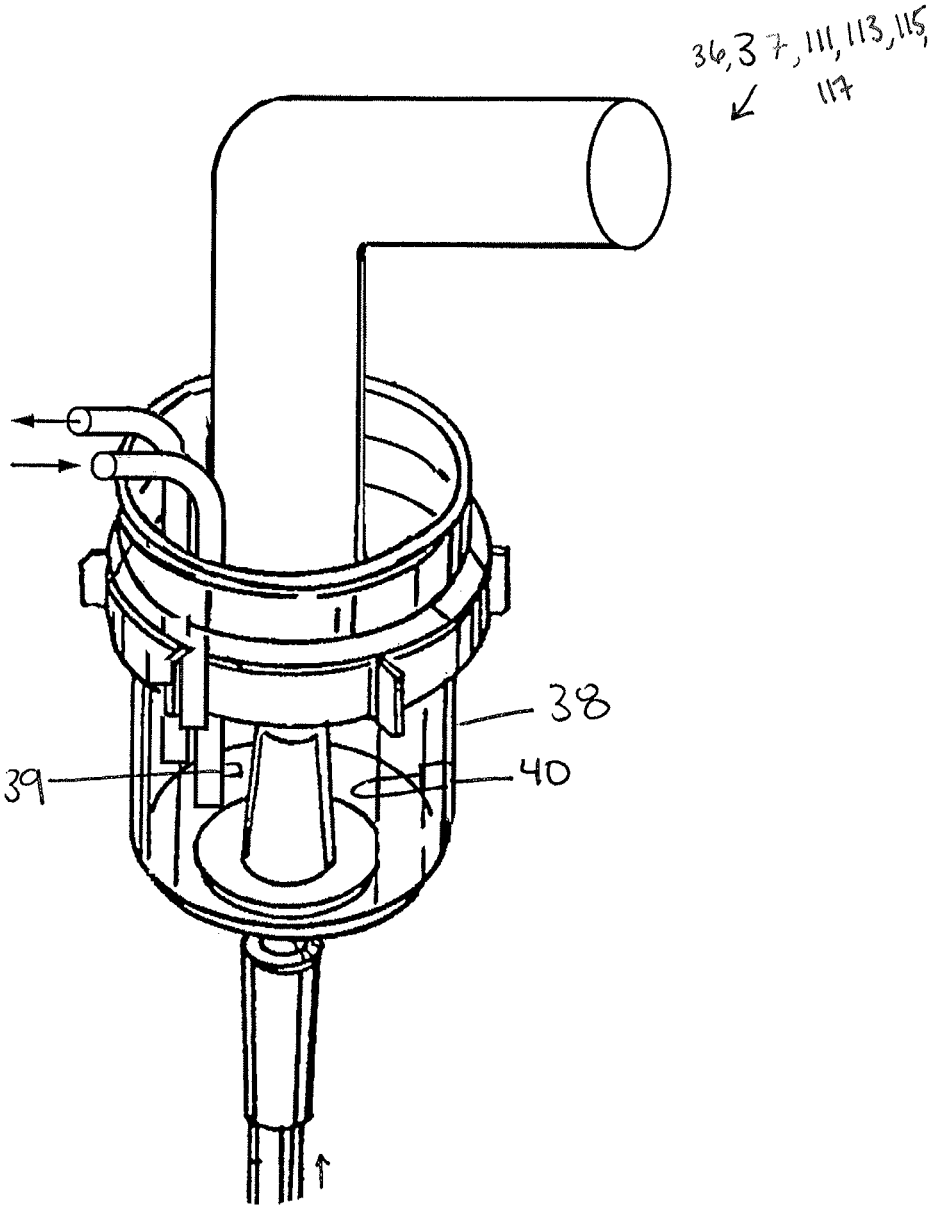
FIG. 6 is a perspective front view of the nebulizer in accordance with the oven of FIG. 2.
Figure 7:
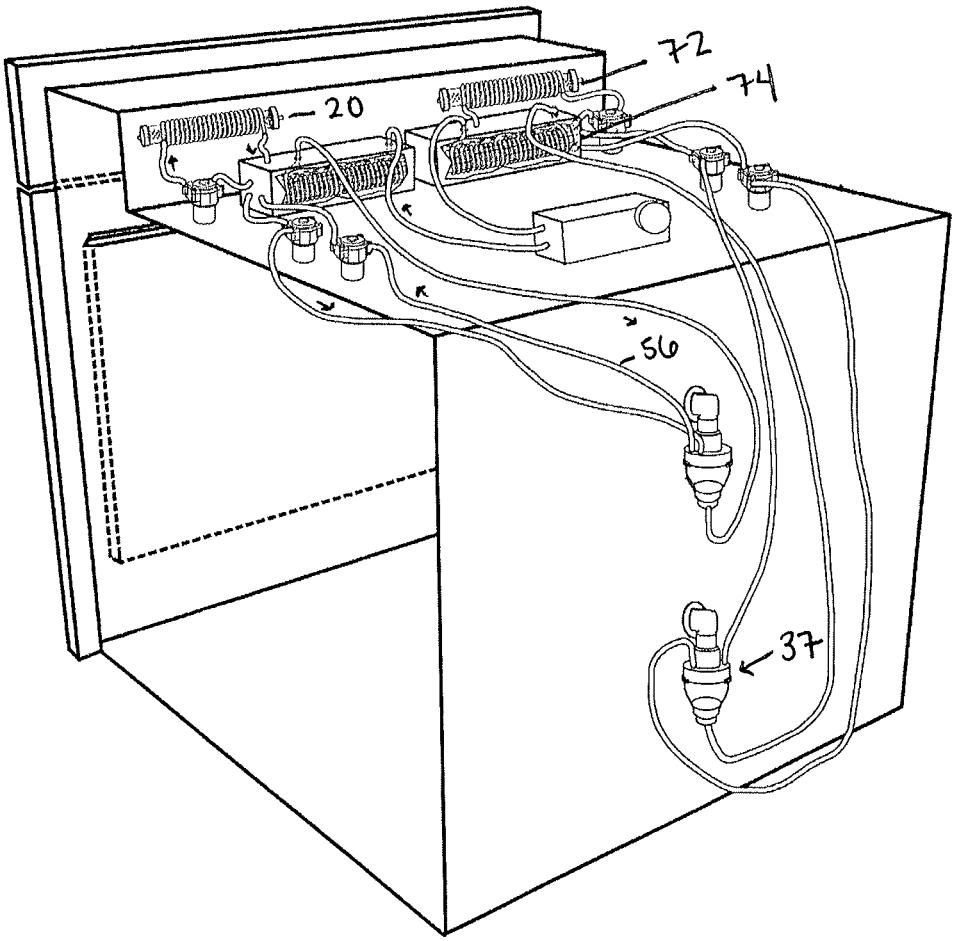
FIG. 7 shows a back, perspective view of a fourth embodiment of the oven of FIG. 2.
Figure 8:
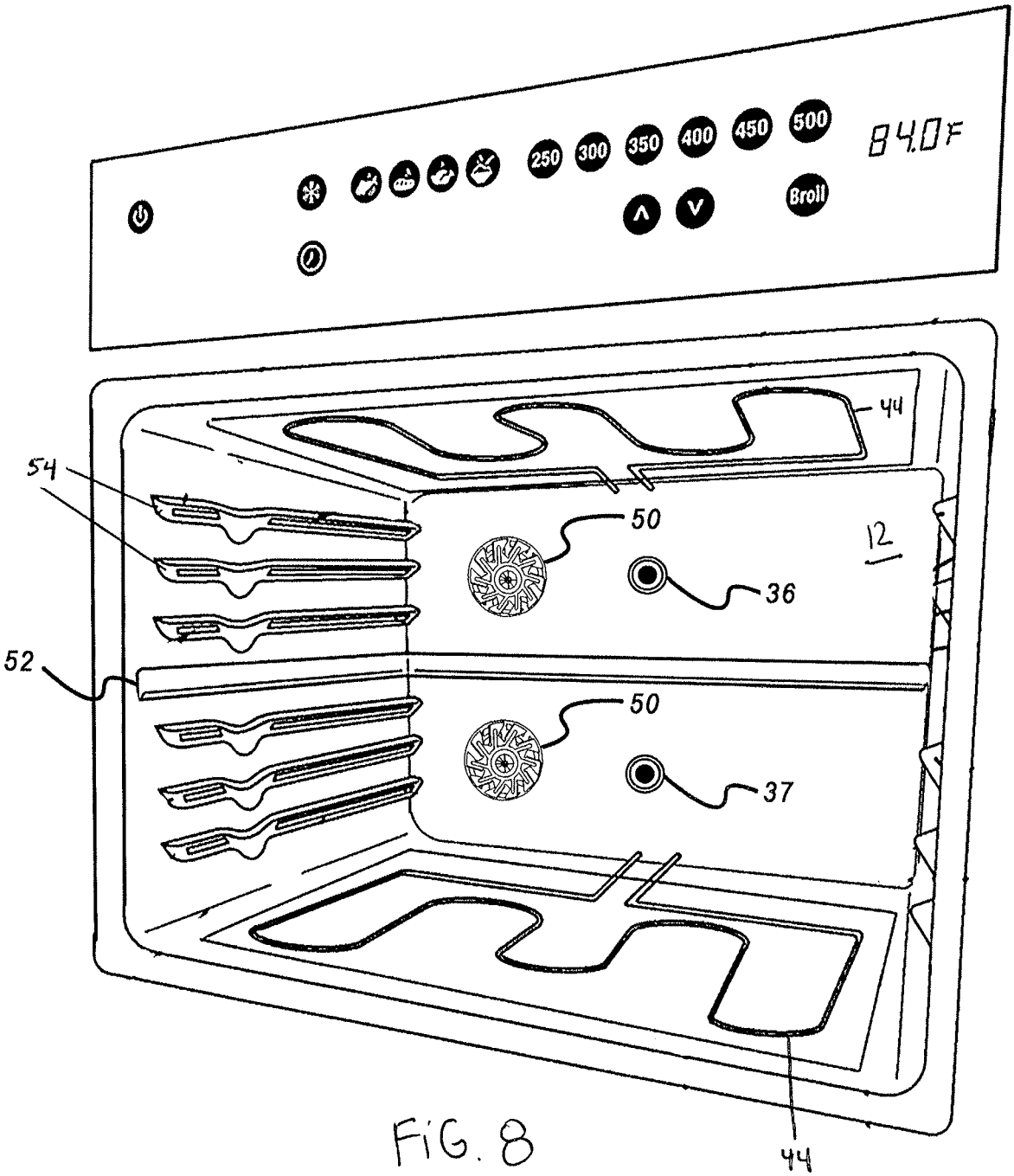
FIG. 8 is an open front perspective view of the fourth embodiment of the oven shown in FIG. 7.

A further embodiment of the nebulizer (36) includes a feed bowl (38), as shown in FIG. 6. The feed bowl of nebulizer includes a float switch (40) that detects the level of water within the nebulizer. If the water level rises above a predetermined level, the float switch activates a suction line that draws the excess heated water out of the nebulizer and recirculates this water back to the reservoir (14) for further heating and recirculation throughout the oven. The float switch level of activation is precisely set to ensure correct water delivery level to the nebulizer so as to avoid overfilling. Further, the nebulizer (36) includes a temperature probe (39), as shown in FIG. 6. These temperature probes sense the temperature of the water in the nebulizer. If the temperature is not at the desired end point temperature necessary to cook the food, the oven makes fine-tuned adjustments.

In an alternative embodiment of the oven of FIG. 2, the excess heated water from the nebulizer (36) is pumped through an additional water heater coil (not shown) before it reaches the reservoir. This is advantageous as the excess water that is pumped through a suction line from the nebulizer is heated to the desired end point temperature before reaching the reservoir. This leads to an energy efficient system that does not require excess time to reheat the water as the temperature of the water stays at the desired end point temperature throughout the recirculation process.

In the first embodiment, the cooking chamber (12) of the oven (10), includes a dry-bulb temperature probe (not shown). The dry-bulb temperature probe partially senses the temperature emitted by a radiant heat element (44), such as a nichrome ribbon-wire infra-red broiler plate, that is located within the cooking chamber. The radiant heat element raises the dry-bulb ambient air temperature of the oven and can be independently controlled to create the desired differential in wet-bulb and dry-bulb temperature. Further, the radiant heat element aids in aesthetic finishing of the food, for example, by creating a typically desired browned, or crispy surface of the food.

In this embodiment, the cooking chamber (12) further includes a wet-bulb temperature probe (not shown) that may be inserted into the food that is being cooked. The wet-bulb temperature probe and the dry-bulb temperature probe continuously sense the wet-bulb and dry-bulb differential to ensure the oven is maintaining the preselected temperature. The temperatures sensed are then relayed to the corresponding wet-bulb and dry-bulb PLDs for readjustment by a series of thermostatic controllers that monitor and alter the inputs to the respective heater circuits. Further, to aid in cooking more than one food at a time, the cooking chamber includes removable racks, which hold the food, are horizontally secured into rack slots (54) within the cooking chamber. The oven (10) may also include a fan (50), such as a convection fan, to ensure the temperature-controlled water vapor and the compressed air reach all surfaces of the food and to mix the water vapor and ambient air.

In a third embodiment, as shown in FIG. 4, the oven (10) includes a chilling, cooling or refrigeration element, wherein either independently, or in addition to heated air and heated water being pumped to the nebulizer (36), chilled air and water is delivered to the nebulizer. In this embodiment, the air is piped through the air heater coil, but other embodiments include alternative means of transferring the air, such as a pump.

In this third embodiment, as shown in FIG. 4, there is a chilled reservoir (60) that is located outside a cooking chamber (12) of the oven (10). This chilled reservoir contains water that is pumped into the chilled reservoir at a set temperature, for instance from a cold-water tank. If the water is manually inserted or pumped from a municipal water source into the chilled reservoir, a Peltier thermoelectric block (70) is located underneath the chilled reservoir. For the refrigeration embodiment, in order to meet USDA food safety guidelines, the water temperature of the chilled water would be less than about forty degrees Fahrenheit, but the temperature of the chilled water can be any temperature necessary. The chilled water temperature ranges from about 30 degrees Fahrenheit and 50 degrees Fahrenheit. For example, the Peltier plate block could be set at a specific controllable temperature that cools the chilling water to 35° F. and introduce nebulized water at that temperature. This desired end point temperature is determined by a user of the oven when he manually enters the desired end point temperature or selects a predetermined cooking program. Present within the chilled reservoir of water is a temperature probe (not shown) that senses the temperature of the water within the chilled reservoir and relays this temperature data to a PLD, which fine-tunes the temperature of the water within the chilled reservoir by controlling the temperature of the Peltier block. The chilled reservoir contains an air chilling coil (66), which is hollow such as copper coil or coiled copper tubing, that is submerged within the chilled water of the chilled reservoir. The air chilling coil retains the temperature of the water within the chilled reservoir so that the air that is pumped through the air chilling coil is set at the desired end temperature. The air can be pumped either from the same compressor (30) that is used for the air heater coil (32) or it can be from a separate compressor.

Once the water within the chilled reservoir (60) is at the desired end temperature, the chilled water and the chilled air are pumped to the nebulizer (36), as shown in FIG. 4. In this embodiment, the chilled air and chilled water are pumped to the same nebulizer as the heated air and heated water. Accordingly, the nebulizer nebulizes the heated water and chilled water into heated and chilled water particles. These heated and chilled water particles are introduced into the cooking chamber (12) via the heated and chilled air. In this embodiment, there are separate air lines from the heated air coil and the chilled air coil, both of which join at a y-split (68). The y-split is advantageous as it aids in the mixture of the air temperatures before reaching the nebulizer. Further, the water and air lines of the oven (10) include various valves, such as solenoid valves, which are advantageously compact. These valves work in combination with the PLD's of the oven and open and close based on whether power is supplied to them. In this embodiment, the nebulizer includes a recirculation line (56) to recirculate water back to the heated water reservoir (14) or chilled water reservoir depending upon which circuit is being utilized by that specific nebulizer. Alternatively, the recirculation line includes a third water heater coil (not shown) that heats the mixed chilled and heated water back to the desired end point temperature before recirculating through the reservoir of heated water. In addition, there is a chilled water recirculation line (57), which recirculates excess water back to the chilled water reservoir (60).

In an additional embodiment, the chilled water is delivered to a separate nebulizer than the heated water and heated compressed air (not shown). The nebulizer uses standard nebulizing techniques to nebulize the chilled water into chilled water particles. These chilled water particles are introduced into the cooking chamber (12) via the chilled compressed air. In this embodiment, the nebulizer contains a float switch (not shown) that detects the water level within the nebulizer. If the water level rises above a predetermined level, the float switch activates a suction line that draws out the excess chilled water and recirculates this chilled water back to the chilled reservoir for recirculation throughout the oven (10).

As shown in FIGS. 8, 9, 11, 12 and 15-16, the food preparation device (10, 100) contains various chambers, which are independently monitored and controlled. There is no limitation on the number and size of the chambers located within the device as each device is manufactured according to user need. For example, as shown in FIGS. 8, 9, and 15-16 the device contains two chambers, while the embodiment in FIG. 12 contains four chambers. The number of chambers may differ when the device is used in an industrial kitchen where food requires cooking, cooling, and storage, than when the device is used by a user in a home. Advantageously, this device is flexible due to the small amount of water that is necessary for the device to operate, so the device can be easily manufactured based on user need. Further, the size of the nebulizers is small and compact, permitting more than one nebulizer to be secured to the device, such as on the backside thereof.

Figure 11:
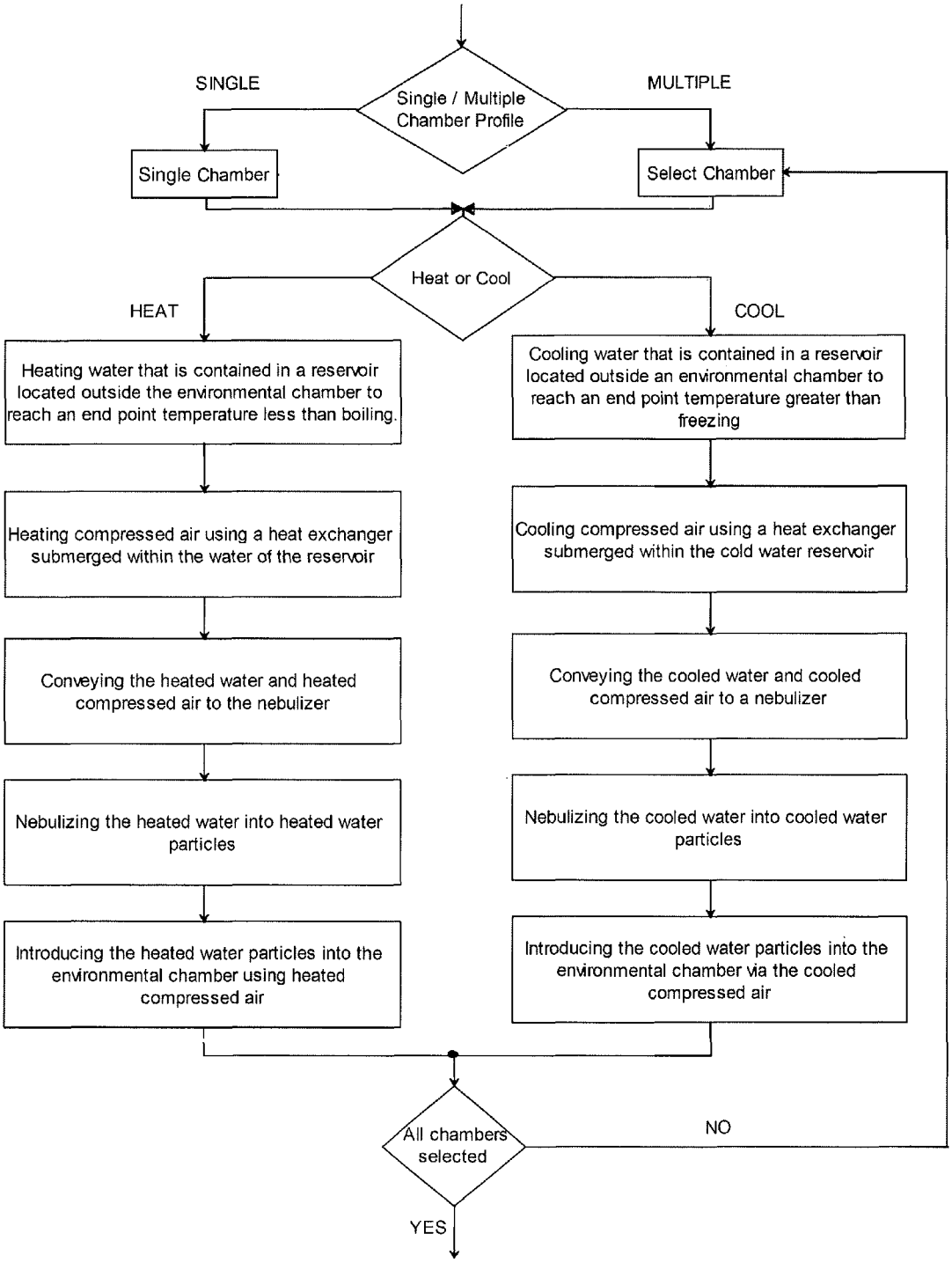
FIG. 11 is a schematic diagram of a process of heating, cooling, or heating and cooling single or multiple chambers of a food preparation device using nebulized water particles and compressed air.
Figure 11:
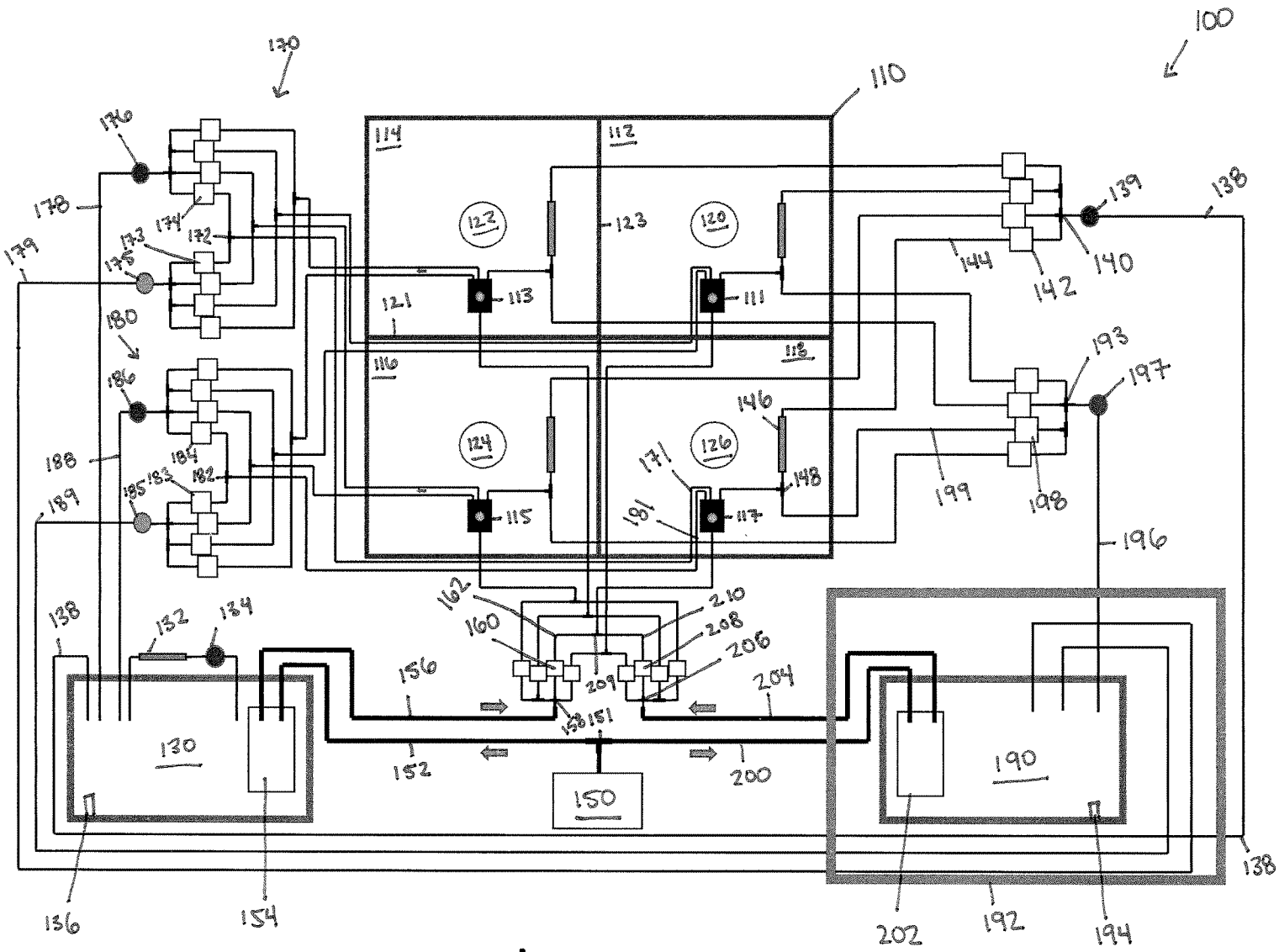
Figure 13:
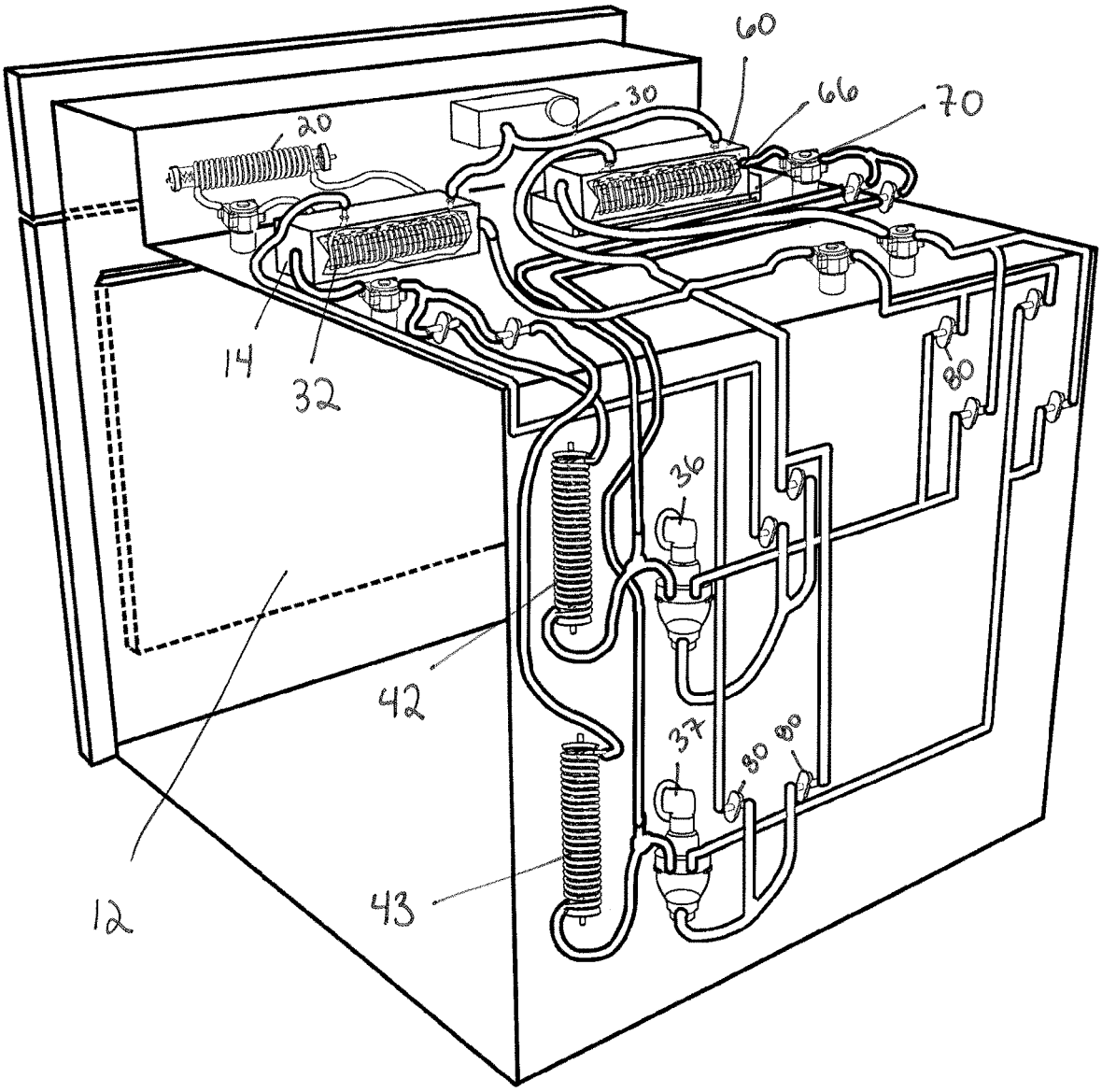
FIG. 13 is a back, perspective view of a sixth embodiment of the oven of FIG. 2.
Figure 14:
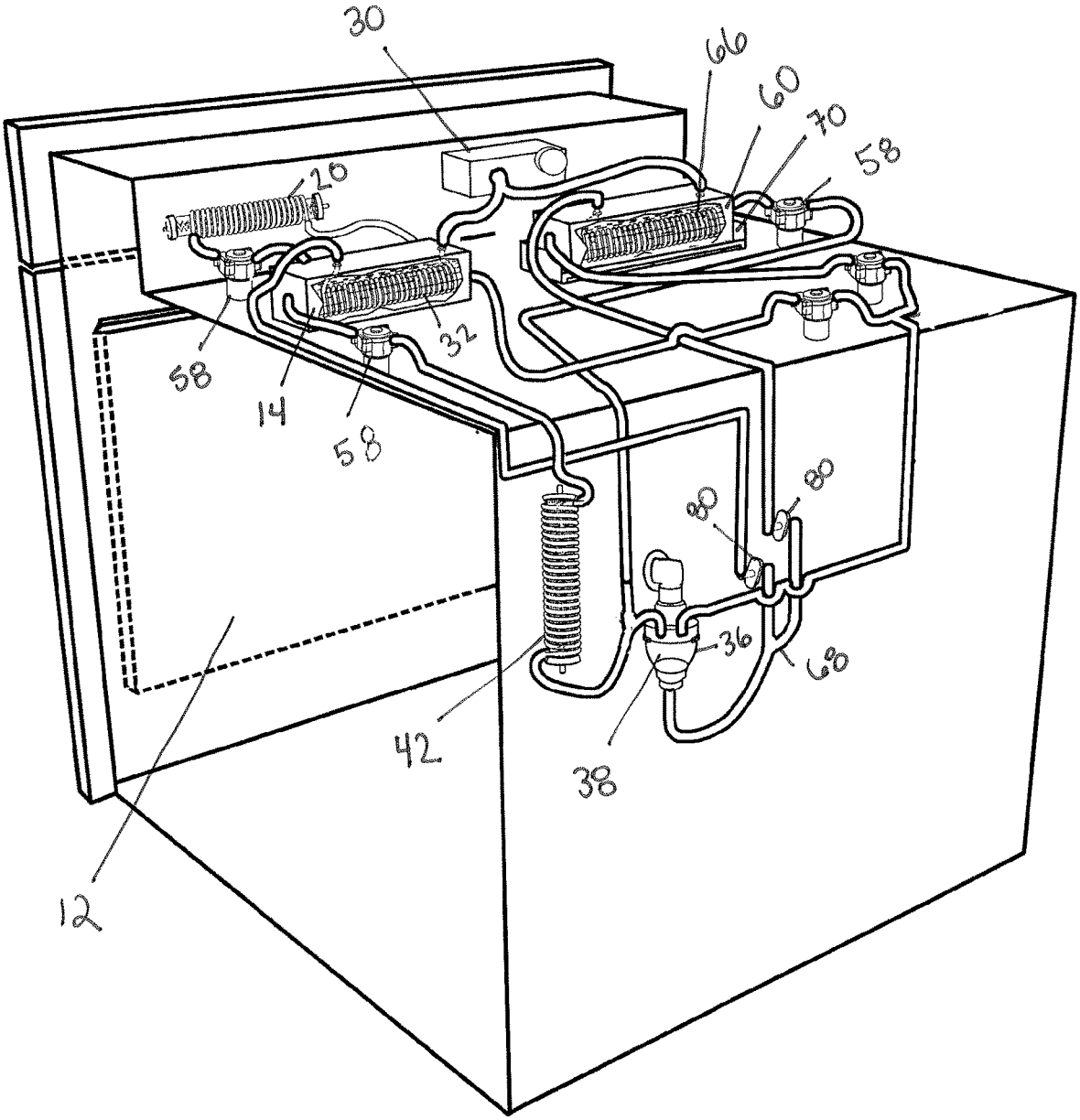
FIG. 14 is a back, perspective view of a seventh embodiment of the oven of FIG. 2.
Figure 15:
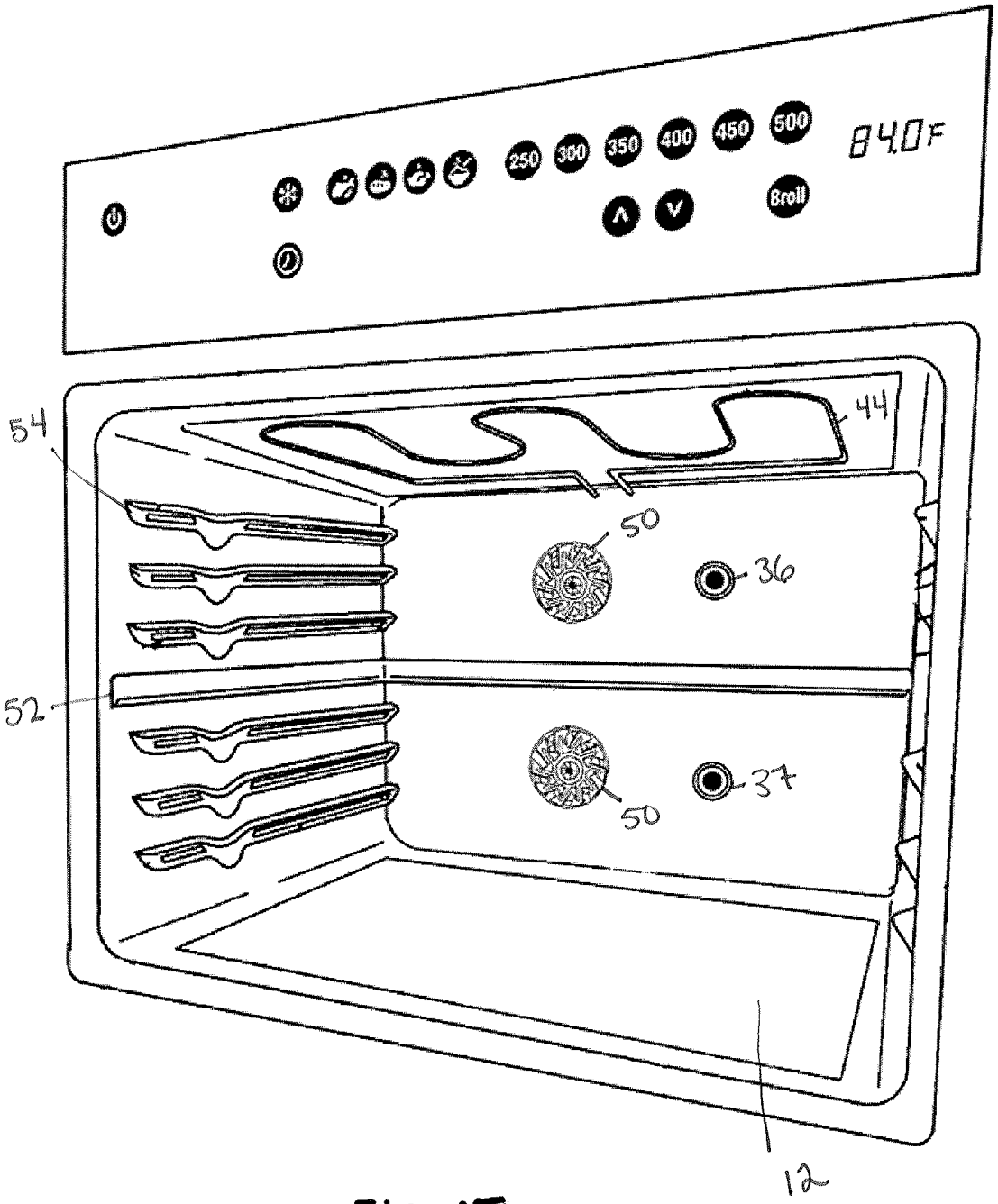
FIG. 15 shows the embodiment of FIG. 8 with one radiant heat element present within one cooking chamber of the oven.

FIG. 11 is a schematic diagram of a process of heating, cooling, or heating and cooling single or multiple chambers of a food preparation device (100) using nebulized water particles and compressed air, as shown in FIG. 12. In this embodiment, the food preparation device includes a larger chamber (110) that acts alone or is subdivided into a first chamber (112), a second chamber (114), a third chamber (116) and a fourth chamber (118). The chambers include dividing slots into which removable inserts are secured, such as a vertical insert (121) and a horizontal insert (123). This embodiment of the food preparation device can have one chamber activated at a time, all chambers activated at the same time or any combination thereof. Various combinations of inserts and chambers are manufacturable based on user need. The inventors advantageously discovered a device wherein each chamber is independently controlled and monitored, and each chamber is equipped to be cooled, heated or cooled and heated, which determination is made when a user initially selects a program of the device.

As shown in FIG. 12, the food preparation device (100) includes a first chamber (110) with a first chamber nebulizer (111) and a first chamber fan (120), a second chamber (114) with a second chamber nebulizer (113) and a second chamber fan (122), a third chamber (116) with a third chamber nebulizer (115) and a third chamber fan (124) and a fourth chamber (118) with a fourth chamber nebulizer (117) and a fourth chamber fan (126). In one embodiment, the chambers are further equipped with a radiant heat element, a dry-bulb temperature probe and a wet bulb temperature probe. Each chamber advantageously includes its own nebulizer for the delivery of heated, cooled, or heated and cooled water particles into the respective chamber via heated, cooled, or heated and cooled air. As shown in FIG. 12, the food preparation device includes various input and output lines with various pumps for delivery of heated and cooled water to each respective nebulizer. In addition, the device includes various lines for delivery of heated or cooled compressed air to each respective nebulizer. The air is pumped via the compressor or pumps located throughout the lines to the respective nebulizers. To aid in the device being compact, the air and water lines further include various splitters therein. Further, these water and air lines include various valves, such as solenoid valves, which are advantageously compact. These valves work in combination with the PLD's of the device and open and close based on whether power is supplied to them. The device further includes two recirculation systems (170, 180), which pump excess heated and cooled water from the respective nebulizers to the hot reservoir (130) or cold reservoir (190).

The following examples discuss a method for heating, cooling, and both heating and cooling, the fourth chamber (118) of the food preparation device (100). These examples should not be construed as limiting as they may be applied to other chambers of the device (110, 112, 114, 116), as shown in FIGS. 11 and 12, and any combination thereof. One of ordinary skill in the art would understand the examples specific to the fourth chamber as also applicable to any other chambers of the device.

As shown in FIGS. 11 and 12, when a user desires to cook within or heat one chamber of the food preparation device (100), for example the fourth chamber (118), the user selects a program on the face of the device, as shown in FIGS. 8, 9, 15, and 16 which activates the device. When the device is activated, the heating process is initiated to heat the water and air to a desired end point temperature. The method by which water in the hot reservoir (130) is heated is comparable to that discussed for the embodiment of the oven shown in FIG. 2. The water is pumped from the hot reservoir (130) of water through a hot reservoir water heater (132) and back into the reservoir via a hot reservoir water heater pump (134). This hot reservoir water heater is shown in detail in FIG. 5. This cycle of heating water in the hot reservoir continues until the reservoir reaches the desired end point temperature, which is determined, for instance by a temperature probe (136) located therein. The heated water from the hot reservoir is pumped out of the reservoir through a heated water line (138) via a pump (139). The heated water line contains a splitter (140), which splits the line into four separate lines to deliver the heated water to the respective nebulizers. As the fourth chamber has been activated, a corresponding valve (142) is opened and the heated water flows into a heated water line (144) which delivers heated water to the fourth chamber nebulizer (117). The heated water line specific to the fourth chamber nebulizer contains a secondary water heater (146). Each chamber is equipped with a secondary water heater. If the device senses that the heated water is not at the desired end point temperature, this secondary water heater is activated. The device determines whether this secondary heater should be activated based on temperature sensors located throughout the device. This secondary water heater is like the hot reservoir water heater, as shown in FIG. 5. Once passing through the secondary water heater, whether activated or not, the heated water is delivered to the fourth nebulizer, where it combines with compressed heated air.

When the device (100) is activated by the user, the air compressor (150) is activated. The method by which the air from the compressor is heated is comparable to the other embodiments of the device, for example, the oven shown in FIG. 2. Compressed air is pumped at a specific velocity from the compressor through a splitter (151). This splitter is beneficially located near the output of the air and is connected to an air line (152) that leads to the hot reservoir (130) and an air line (200) that leads to the cold reservoir (190). Advantageously, one air compressor is needed. Accordingly, air is pumped through the air line to the hot reservoir, where it passes through an air coil (154), which is submerged within the heated water of the hot reservoir. The hot reservoir air coil is made of a conductive material, such as copper, so the air is heated to the desired end temperature through conduction of the air coil or heat exchanger submerged within the heated water of the reservoir. Air is pumped out of this air coil and into an air line (156). The air line contains a splitter (158), which splits the line into four separate lines to deliver the heated air to the respective nebulizers. As the fourth chamber (118) has been activated, a corresponding valve (160) is opened and the heated air flows into an air line (162) which flows to the fourth chamber nebulizer (117). Located within this line is another splitter (209), which advantageously combines the cooled and heated air, if applicable, before passing into the fourth chamber nebulizer. The heated water particles located within the fourth chamber nebulizer are introduced into the fourth chamber via the heated compressed air. The nebulized water particles heat the fourth chamber to the desired end temperature and are continually introduced into the chamber via the heated compressed air.

As shown in FIGS. 11 and 12, each nebulizer includes a first and second recirculation line, through which excess water from the nebulizers is pumped to either the first recirculation system (170), the second recirculation system (180), or both. The two recirculation systems pump excess water from the respective nebulizers to the hot reservoir (130), the cold reservoir (190) or to both. In one embodiment, the recirculation lines that pump excess water to the hot reservoir include an additional water heater to heat the water to the desired end temperature before reentering the hot reservoir. These recirculation systems aid in maintaining the temperature of the water throughout the system, as well as aiding in the small amount of water needed for the device to operate as water is constantly recycled through the system at near perfect temperature.

As shown in FIG. 12, the fourth chamber nebulizer (117) includes a first recirculation line (171) and a second recirculation line (181). These recirculation lines are connected, for example, to a feed bowl of the nebulizer. Depending on the pre-selected program, or whether excess water is building in the nebulizer, the corresponding recirculation line(s) are activated to pump water from the nebulizer to the hot water reservoir (130) or the cold-water reservoir (190). If the first recirculation line is activated, heated water is pumped through the first recirculation line to the first recirculation system (170) via a pump (176). The first recirculation line includes a splitter (172) that splits the recirculation line in two with one end recirculating water to the hot reservoir and the other end recirculating water to the cold reservoir. There are various factors that determine whether the water is recirculated to the hot reservoir or the cold reservoir, which determination is made via the logistics of the device (100). If the water in the first recirculation line is to be pumped to the hot reservoir, a valve (174) is opened, and water is pumped through line (178) into the hot reservoir. This recirculated water is then reheated and repumped throughout the device. If the second recirculation line is activated, heated water is pumped through the second recirculation line to the second recirculation system via a pump (186). The second recirculation line includes a splitter (182) that splits the recirculation line in two with one end recirculating water to the hot reservoir and the other end recirculating water to the cold reservoir. If the water in the second recirculation line is to be pumped to the hot reservoir, a valve (184) is opened, and water is pumped through line (188) into the hot reservoir. This recirculated water is then reheated and repumped throughout the device.

As shown in FIGS. 11 and 12, when a user desires to cool, refrigerate and/or store food within one chamber of the food preparation device (100) for example the fourth chamber (118), the user selects a program on the face of the device, as shown in FIGS. 8, 9, 15, and 16 which activates the device. When the device is activated, the device initiates the cooling processes necessary to cool the water and air to a desired end point temperature. The method by which water in the cold reservoir (190) is cooled is comparable to other embodiments of the device, for example the embodiment shown in FIG. 4. As shown in FIG. 12, the cold reservoir is affixed to or working in conjunction with a Peltier block or Peltier based cooler. Whether the temperature of the water in the cold reservoir has reached the desired end point temperature is determined, for example, by a temperature probe (194) submerged therein. The cooled water is pumped out of the reservoir through a cooled water line (196) via a pump (197). The cooled water line contains a splitter (193), which splits the line into four separate lines to deliver the cooled water to the respective nebulizers. As the fourth chamber has been activated, a corresponding valve (198) is opened and the cooled water flows into a cooled water line (199) which flows to the fourth chamber nebulizer (117).

The method by which the air from the compressor (150) is cooled is comparable to that of other embodiments of the device (10, 100), such as the embodiment shown in FIG. 2. Compressed air is pumped at a specific velocity from the compressor through a splitter (151) and into air line (200) that leads to the cold reservoir (190). The air is pumped through an air coil (202), which is submerged within the cooled water of the cold reservoir. The cold reservoir air coil is made of a conductive material, such as copper, so the air is cooled to the desired end temperature through conduction of the air coil submerged within the cooled water of the reservoir. Air is pumped out of this air coil and into a cooled air line (204). The cooled air line contains a splitter (206), which splits the line into four separate lines to deliver the cooled air to the respective nebulizers. As the fourth chamber has been activated, a corresponding valve (208) is opened and the cooled air flows into a cooled air line (210) which flows to the fourth chamber nebulizer (117). Located within this line is another splitter (209), which advantageously combines the cooled and heated air, if applicable, before passing into the fourth chamber nebulizer. The cooled water particles located within the fourth chamber nebulizer are introduced into the fourth chamber via the cooled compressed air. The nebulized water particles cool, refrigerate or store the food to the desired end temperature and are continually introduced into the chamber via the cooled compressed air.

As shown in FIG. 12, the fourth chamber nebulizer (117) includes a first recirculation line (171) and a second recirculation line (181). If the first recirculation line is activated, cooled water is pumped through the first recirculation line to the first recirculation system (170) via a pump (175). The first recirculation line includes a splitter (172) that splits the recirculation line in two with one end recirculating water to the hot reservoir (130) and the other end recirculating water to the cold reservoir (190). If the water in the first recirculation line is to be pumped to the cold reservoir, a valve (173) is opened, and water is pumped through line (179) into the cold reservoir. This recirculated water is then cooled and repumped throughout the device. If the second recirculation line is activated, cooled water is pumped through the second recirculation line to the second recirculation system via a pump (185). The second recirculation line includes a splitter (182) that splits the recirculation line in two with one end recirculating water to the hot reservoir and the other end recirculating water to the cold reservoir. If the water in the second recirculation line is to be pumped to the cold reservoir, a valve (183) is opened, and water is pumped through line (189) into the hot reservoir. This recirculated water is then cooled and repumped throughout the device.

Any combination of cooling and heating is possible with this device (10, 100). The device uses two active elements in its heating and cooling control system, the PLD controllers and a combinational logic control circuit. The PLD controllers are set to the target food temperature when the operator chooses a program. The PLD's proportional integral derivative algorithm uses input profile settings to quickly and smoothly achieve and maintain the target temperature. The PLDs monitor and respond to the changing temperature of the food as it is affected by the process, generating specific demand signals to affect changes in the logic control circuitry. The logic control circuitry turns the electrical relays on or off, which relays turn on or shut down various elements of the device, such as the heaters, pumps, valves, compressors, solenoids, and cooling elements necessary to heat or cool the various device's environments in order to meet the operators' desired condition. The sequence of events is captured in the process flow diagram shown in FIG. 11.

The control system determines the appropriate valves to be opened, pumps to be activated, and to what temperature the air and water should be heated or cooled. Further, the compressed air delivers the water particles at the precise velocity necessary. As shown in FIGS. 11 and 12, when a user desires to utilize both the heating and cooling aspects of the device in one chamber, for example the fourth chamber (118), the user selects a program on the face of the device, as shown in FIGS. 8, 9, 15, and 16 which activates the device. The program, for example, includes cooking food and then holding said food for a period within the chamber at a cooled or refrigerated temperature. The cooled and heated portions can both be activated at varying times to maintain the precise end temperature of the water and air. The water is heated and cooled as discussed above utilizing the hot reservoir (130) and the cold reservoir (190). The heated and cooled water are pumped through the respective heated and cooled water lines (138, 196) where they combine, if applicable at the splitter (148) before entering the fourth chamber nebulizer (117). The heated and cooled water are pumped into the nebulizer at the same time or differing times, based on whether the valves (198 and 142) are opened.

Further, air is pumped from the compressor (150) through the splitter (151) to the hot reservoir and the cold reservoir via the respective lines (152, 200). As the fourth chamber is being heated and cooled, heated and cooled air combine at the splitter (209) and are delivered into the fourth chamber nebulizer at the same time or differing times depending on whether the respective valves are open (160, 208). The fourth chamber nebulizer (117) has two recirculation lines (171, 181) that pump heated or cooled water from the nebulizer to the first and second recirculation systems depending on which valves are opened (173, 174, 183, 184). Any combination of recirculation is possible depending on the temperature of the water within the system.

In a fourth embodiment, as shown in FIGS. 7-8 and 13-14, more than one nebulizer may be present on the backside of the cooking chamber (12) to aid in split level cooking. In this embodiment, the cooking chamber has numerous different compartments of varying sizes that are independently controlled and monitored. Advantageously, the size of the nebulizers (36, 37) is small and compact, that more than one nebulizer can be secured to the oven (10). Accordingly, each nebulizer, whether receiving heated water and heated air, chilled water and chilled air, or both heated and chilled water and heated and chilled air, independently disperses the respective water particles into the independent cooking chambers.

Figure 9:
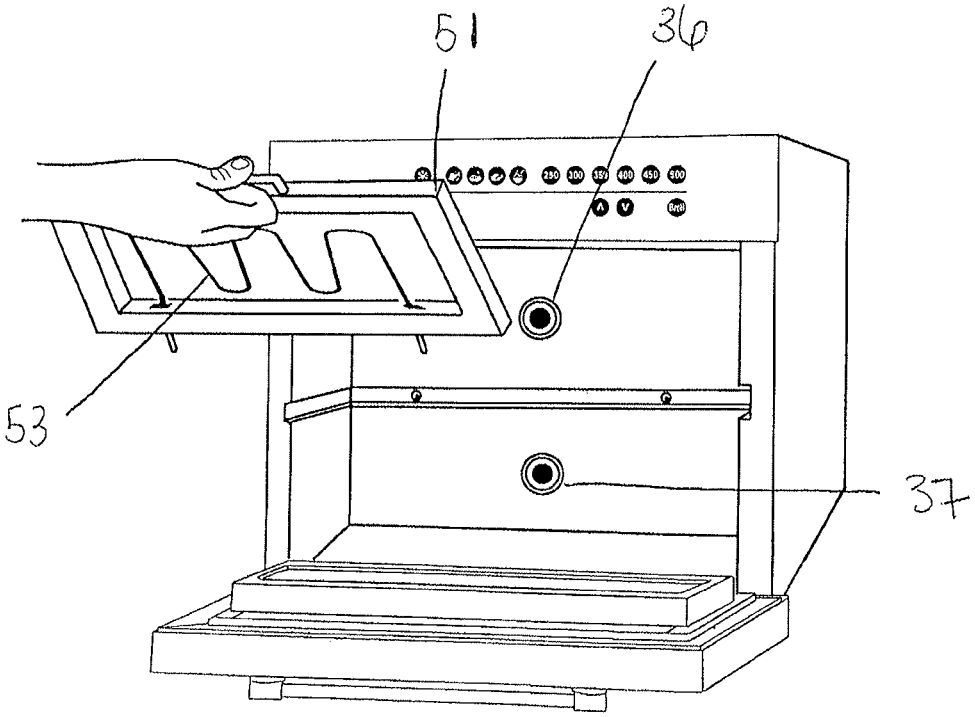
FIG. 9 is an open front perspective view of the fourth embodiment of the oven shown in FIG. 7.
Figure 16:
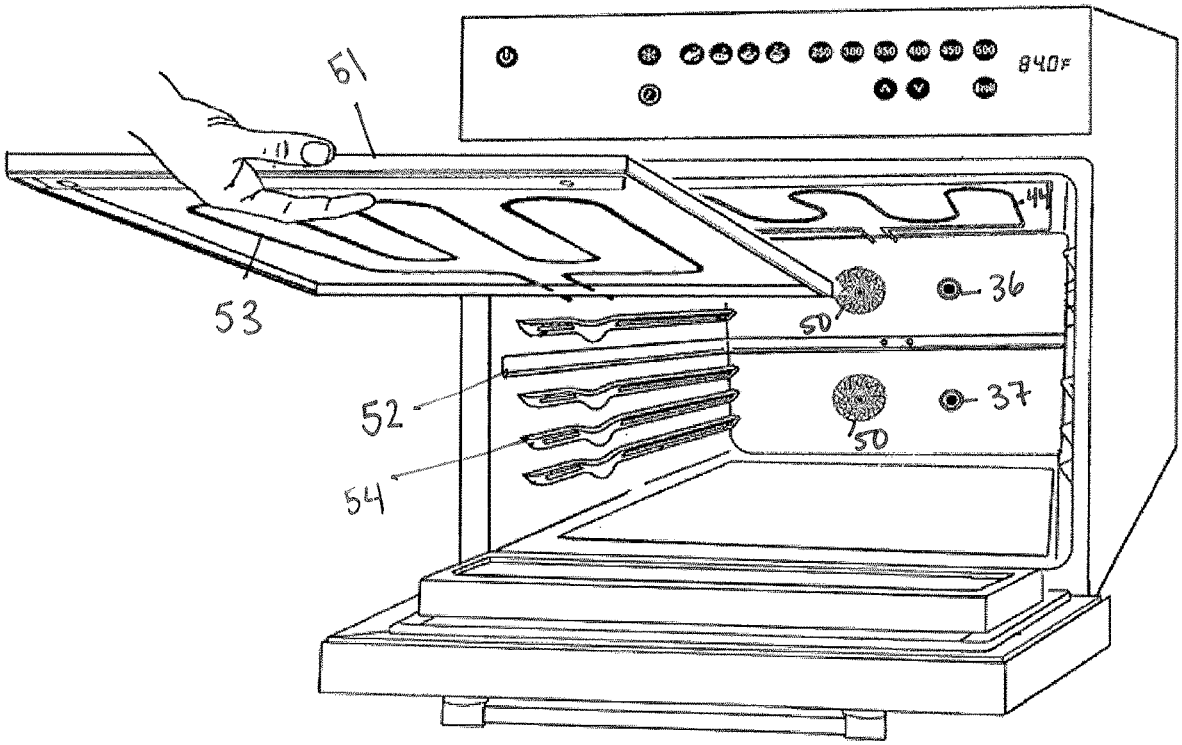
FIG. 16 shows the embodiment of FIG. 9 with one radiant heat element present within one cooking chamber of the oven.

This is advantageous if the user is cooking multiple different foods that require separate cooking temperatures and times. For example, in an additional embodiment for split level cooking, as shown in FIGS. 8-9 and 15-16, the user slides a dividing plate (51) into dividing slot (52) in the cooking chamber (12) of the oven (10). As shown in FIGS. 9 and 16, the dividing plate may be equipped with its own radiant heat element (53), dry-bulb temperature sensor (not shown), a condenser circuit (not shown) and wet-bulb temperature sensor (not shown). The dividing plate is fitted with appropriate gasket material on all sides of the plate, allowing the new, sub-divided chamber created by the plate to contain its own environment separate from the other areas of the oven. The connections for the wet and dry-bulb temperature sensors are provided by contacts in the rear of the plate, which connect as the plate is secured into position. This provides the user with multiple spaces within the oven to cook different foods to separate controllable temperatures and outcomes. For example, a turkey can be cooked to the 165-degree Fahrenheit end point temperature while a dish containing mashed potatoes and another dish containing a casserole may be cooked to a desired end-point temperature of 135 degrees Fahrenheit. The oven in this divided state can hold these dishes indefinitely at 135 degrees and not overcook those items while the turkey in the other divided cavity can be cooked and held at 165 degrees.

Figure 10:
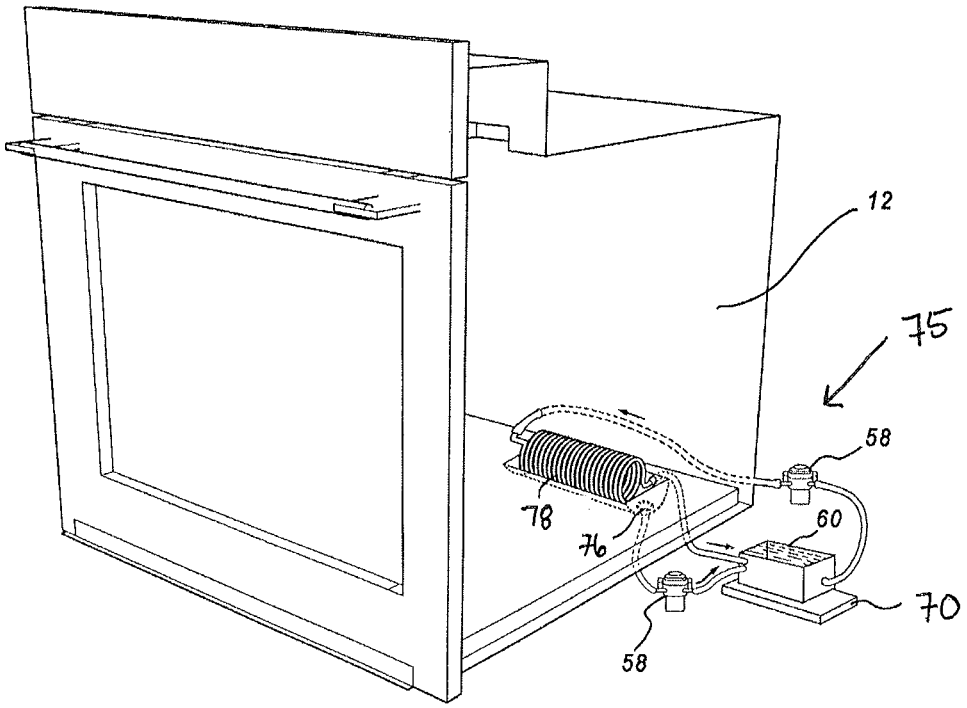
FIG. 10 is an open side perspective view of a fifth embodiment of the oven shown in FIG. 2.

In a fifth embodiment, as shown in FIG. 10, the oven further includes an air condenser circuit (75) including a trough (77) located at a bottom of the cooking chamber, wherein the trough includes a condenser coil (78) and a drain (76), wherein both ends of the condenser coil are connected to a second reservoir of chilled water. For example, one embodiment of the condenser circuit may utilize the same chilled water reservoir (60) that is chilled by a Peltier plate block (70), while another embodiment may use a separate chilled water reservoir (not shown). In this fifth embodiment, chilled water is pumped through the air condenser coil, which is preferably a coil of metal tubing made of copper, which is mounted on the floor at the rear of the cooking chamber. The condenser coil is located in a recessed trough in the floor of the cooking chamber. The trough has a drain hole at one end of it and may be angled down toward the drain hole to facilitate drainage toward the drain hole. As the chilled water is pumped through the copper condenser coil, the warmer nebulized air in the cooking chamber (12) is rapidly condensed by the cooler surface of condenser coil. The water that condenses on the surface of the coil collects and drips into the drain in the trough where it is pumped back through the chilled reservoir of water. In this embodiment, the previous nebulized water vapor heated to a certain temperature is quickly and efficiently removed from the cooking chamber and nebulized water vapor at a different temperature may immediately be introduced into the cooking chamber.

All embodiments of the device (10, 100) advantageously utilize a small amount of water necessary to operate, so the device is capable of being utilized in a multitude of ways. For example, the device is easily scaled to the size desired by the user. For example, when the process and device is used in modular form, the elements of the device are smaller in scale, for example, the entire device may be incorporated into a container as small as six inches by six inches by ten inches. The small size of the device is advantageous as it offers an advantage of simple replacement when components fail instead of having to troubleshoot discrete components. Furthermore, when the device is manufactured in a larger module design to affect a greater area with nebulized water particles, multiple nebulizer outlets may be arranged together, facing in any direction and height required by the intended effect upon the space. Nebulized water particles tend to evenly and fully fill any volume in which they are introduced, but sometimes a greater volume of the nebulized water vapor is necessary to create the desired effect on the target. The additional outlets provide a smoothing effect on the temperature and humidity if an area is undersupplied or under or over ambient temperature due to the interior space's construction or layout.

In addition, there are many low-temperature cooking techniques and recipes that greatly benefit from the food preparation device (10, 100). For example, proofing doughs and breads, or baking wet pastries and desserts, such as cheesecakes, which are more precisely prepared with the unique combination of heat and water vapor utilized by the oven. The inventors have discovered a process that supplies the exact temperature and humidity required during the proofing of dough, which process can require temperatures as low as 50° F. to a high of 95° F. The chilled and heated nebulization process is extremely precise and can be automated to meet an operator's specific recipes.

In any uses and embodiments of the oven or food preparation device (10, 100), multiple nebulizers may be located within each chamber of the device, or multiple nebulizers in each chamber are separated by permanent or movable inserts, which easily provide more than one precise humidity and temperature-controlled area for the uses desired by the user. Accordingly, the process and device utilizing nebulized water particles and air is advantageous as or with a holding cabinet. By utilizing this device and process, the food does not dry out and remains healthful, and more importantly, the desired aesthetic qualities of the food product are not compromised by holding. Further, when the food is removed from the cabinet, the process quickly replenishes the necessary moisture at the exact desired temperature due to the continuous activity of the process and nebulizers. Accordingly, the process of heating food with heated nebulized water particles provides fast and safe recovery of the correct holding environment. In addition, the process is highly controllable, allowing the food service operator to set the precise level of nebulized water particles necessary to hold the food at an optimum level of moisture, thereby eliminating oversaturation or overcooking. Accordingly, the device is easily manufacturable to operate with or as a holding cabinet.

Moreover, the process and device (10, 100) utilizing nebulized water particles and air is advantageous as a heated or cooled display case. By utilizing this device and process, the product stored within the display case is continuously held with the precise amount of moisture and temperature, allowing the food to stay at an optimum condition for sale, remain in a more healthful state and reduce spoilage and loss. Accordingly, the device is easily manufacturable to operate with or as a display case.

Moreover, the process and device (10, 100) utilizing nebulized water particles and air is advantageous as a wine cooler. By utilizing this device and process as a wine cooler, the precise level of nebulized humidity is continuously delivered to the wine cooler chambers, which provides the wine with the precise amount of moisture necessary to keep it at an optimum condition and storage for a variety of different wines. Accordingly, the device is easily manufacturable to operate with or as a wine cooler.

Furthermore, the process and device (10, 100) utilizing nebulized water particles and air is advantageous for dry aging meats. Controlled temperature and relative humidity of air plays a crucial role in the dry aging process. If the humidity is too high, spoilage bacteria can grow and if the humidity is too low it restricts bacterial growth while also promoting greater evaporative weight loss, so beef dries out too quickly causing the meat to have less juiciness than desired. The nebulization process and device deliver the correct, precise level of nebulized humidity and air flow into the dry-aging chamber thereby providing the product with the precise amount of moisture to cure meat products at an optimum rate and reducing spoilage and loss. Accordingly, the device is easily manufacturable to operate with a dry aging meat.

In addition, the process and device (10, 100) utilizing nebulized water particles and air is advantageous for preserving water within fruits and vegetables. For example, injecting the correct, precise level of nebulized humidity and air flow into a refrigerator crisper drawer provides the stored food with the precise amount of moisture, allowing the stored fruit and vegetables to stay in good condition, while reducing spoilage and loss. Accordingly, the device is easily manufacturable to operate with preserving fruits and vegetable in a crisper drawer.

Moreover, the process and device (10, 100) utilizing nebulized water particles and air would be advantageous as aiding in poultry production from egg to chicken. Good egg incubation requires the operator to precisely lower the humidity during the process while maintaining a perfect target temperature. The process is critical as the resulting hatch forever exhibits characteristics caused by any improper conditions during incubation. Some kinds of poultry require a targeted 15% reduction of the interior volume of the egg yolk during egg incubation by manipulating humidity and temperature levels and current technology does not allow the operator a precise way to affect this reduction. The process and device utilizing nebulized water particles and air provides perfect temperature and humidity control and continuously alters these variables as necessary while monitoring the weight loss of the incubating eggs. Furthermore, utilizing heated and chilled nebulized particles of water allows a hatchery operator near perfect, easily controlled temperature and humidity within their hatcheries and chicken houses. Further, the nebulization process is easily be scaled to meet industry recommended hatchery sizes by installing several process system units that specifically meet the size and population of each space. Accordingly, the device is easily manufacturable to operate with incubating chicken eggs.

Moreover, the process and device (10, 100) utilizing nebulized water particles and air is advantageous for plant seed germination as the most important external factors for germination include the correct temperature, humidity, water, atmosphere and sometimes light or darkness. The nebulization of water particles introduced under forced air overcomes the inherent problems of ambient air temperature affecting growing plants. Although air temperature has a significant effect on root zone temperature, the root zone is often significantly cooler than the air. Many of these factors reduces the media temperature to below that of the air temperature. When most floriculture crops are propagated, light levels are low, so the amount of heating from sunlight is minimal. The process and device utilizing nebulized water particles quickly raises or lowers every water-laden molecule of the plant and the growing media to the temperature of the nebulized water particles. Accordingly, changes are precisely and immediately made so all temperature and humidity targets are easily met and supplied. Accordingly, the device is easily manufacturable to operate with plant and seed germination.

Moreover, the process and device (10, 100) utilizing nebulized water particles and air would be advantageous for NICU, Special Care and Well Newborn Nurseries as temperature and humidity are key to newborn infant survival and growth. The process and device utilizing nebulized water particles and air immediately and precisely permeates individual bassinets and nursery areas with the combined target humidity and temperature levels. Furthermore, the interior volume is immediately flooded with the desired temperature and humidity when an access point is closed, returning both the infant and environment to the target temperature and humidity set points within seconds. Accordingly, the device is easily manufacturable to operate with bassinets or nursery areas.

Moreover, the process and device (10, 100) utilizing nebulized water particles and air would be advantageous for use with or as a Heating, Ventilation and Cooling (HVAC) systems system. Adding the nebulization of water particles as a source of humidity in the (HVAC) systems in living spaces, working spaces and vehicles is more efficient and safer for addressing levels of environmental humidity that are either too high or low than those offered by current humidification techniques. Further, current techniques do not provide the precision control of temperature and humidity offered by the nebulization process and device. Further, current HVAC techniques cause health problems and cause damage to the living and working environment by overdrying the air in the heating and air-conditioning cycles and humidity targets are not easily met. The process and device utilizing water particles and air are for instance, manufactured with or may be added as a humidification unit directly into a building or vehicle's heating and cooling system. This application of the process and device also requires use of a hygrometer to monitor the humidity output, allowing for automatic trimming of the process output. Further, adding an inline UVC light sterilizer to the water lines would ensure bacteria in the water are eliminated before nebulization and distribution. Accordingly, the device is easily manufacturable to operate with an HVAC system.

It is well recognized by persons skilled in the art that alternative embodiments to those disclosed herein, which are foreseeable alternatives, are also covered by this disclosure. The foregoing disclosure is not intended to be construed to limit the embodiments or otherwise to exclude such other embodiments, adaptations, variations, modifications and equivalent arrangements.

LISTING OF ELEMENTS

Oven 10
Cooking chamber 12
Reservoir of water 14
Reservoir temperature probe (not shown)
Reservoir float switch (not shown)
First water heater coil 20
Resistance wire 22
Glass ceramic tubing 24
Coiled copper tubing 26
Air compressor 30
Air heater coil 32
Copper coil 34
Nebulizer 36
Second nebulizer 37

Feed bowl 38
Nebulizer Temperature Probe 39
Float Switch 40
Second water heater coil 42
Third water heater coil 4 (not shown)
Radiant heat element 44
Dry bulb temperature probe (not shown)
Wet bulb temperature probe (not shown)
Fan 50
Dividing plate 51
Dividing slots 52
Radiant heat element 53
Rack slots 54
Recirculation line 56
Chilled water recirculation line 57
Water pumps 58
Chilled water reservoir 60
Chilled water reservoir float switch (not shown)
Chilled water reservoir temperature probe (not shown)
Chilled air coil 66
Y-Split 68
Peltier Block 70
Fourth water heater 72
Second air heater coil 74
Condenser circuit 75
Drain 76
Condenser coil 78
Trough 77
Valves 80
Food preparation device 100
Chamber 110
First chamber nebulizer 111
First chamber 112
Second chamber nebulizer 113
Second chamber 114
Third chamber nebulizer 115
Third chamber 116
Fourth chamber nebulizer 117
Fourth chamber 118
Fan in first chamber 120
Horizontal dividing plate 121
Fan in second chamber 122
Vertical dividing plate 123
Fan in third chamber 124
Fan in fourth chamber 126
Hot water reservoir 130
Hot water reservoir water heater 132
Hot water reservoir water heater pump 134
Hot reservoir temperature probe 136
Heated water line from hot reservoir 138
Pump in heated water line from hot reservoir 139
Splitter in heated water line from hot reservoir 140
Valve in heated water line from hot reservoir to fourth chamber nebulizer 142
Water line to fourth chamber nebulizer 144
Secondary water heater 146
Splitter connecting water lines from hot reservoir and cold reservoir for the fourth chamber nebulizer 148
Air compressor 150
Air line splitter 151
Air line from compressor to hot reservoir 152
Hot reservoir air coil 154
Air line from hot reservoir air coil 156
Splitter in air line from hot reservoir air coil 158
Valve in air line from hot reservoir air coil to fourth chamber nebulizer 160
Air line to fourth chamber nebulizer 162
First water recirculation system 170
First recirculation line from the fourth chamber nebulizer 171
Splitter in first recirculation line 172
Valve in first recirculation line to the cold reservoir 173
Valve in first recirculation line to the hot reservoir 174
Pump in first recirculation line to the cold reservoir 175
Pump in first recirculation line to the hot reservoir 176
First recirculation line to hot water reservoir 178
First recirculation line to cold water reservoir 179
Second water recirculation system 180
Second recirculation line from the fourth chamber nebulizer 181
Splitter in second recirculation line 182
Valve in second recirculation line to the cold reservoir 183
Valve in second recirculation line to the hot reservoir 184
Pump in first recirculation line to the cold reservoir 185
Pump in first recirculation line to the hot reservoir 186
Second recirculation line split to return water to hot water reservoir 188
Second recirculation line split to return water to cold water reservoir 189
Cold water reservoir 190
Peltier block 192
Splitter in cooled water line from cold reservoir 193
Cold water reservoir temperature probe 194
Cooled water line from cold reservoir 196
Pump in cooled water line from cold reservoir 197
Valve in cooled water line from cold reservoir to fourth chamber nebulizer 198
Cooled water line to fourth chamber nebulizer 199
Air line to cold reservoir 200
Cold reservoir air coil 202
Air line from cold reservoir air coil 204
Splitter in air line from cold reservoir air coil 206
Valve in air line from cold reservoir air coil to fourth chamber nebulizer 208
Splitter connecting air lines from hot reservoir and cold reservoir 209
Cold air line to fourth chamber nebulizer 210

The invention claimed is:

1. A process of heating multiple chambers of a food preparation device, wherein the method comprises:

heating water that is contained in a reservoir located outside of the multiple chambers of the food preparation device to reach a desired end point temperature that is less than boiling;

heating compressed air through an air heater that is submerged within the water of the reservoir;

conveying the heated water and the heated compressed air to nebulizers, which nebulizers are connected to the multiple chambers;

nebulizing the heated water into heated water particles; and introducing the heated water particles into the multiple chambers via the heated compressed air.

2. The method of claim 1, wherein the water contained in the reservoir is heated by transferring water within the reservoir through a water heater coil.

3. The method of claim 1, further comprising transferring the heated water from the reservoir through a second water heater coil before conveying the heated water to the nebulizers.

4. The method of claim 1, further comprising recirculating excess heated water from the nebulizers to the reservoir.

5. The method of claim 1, wherein the chambers are independently monitored and controlled.

6. The method of claim 1, further comprising:

cooling water contained in a second reservoir that is located outside the multiple chambers of the food preparation device to reach a desired end point temperature that is between about 30 degrees Fahrenheit and 50 degrees Fahrenheit;

cooling compressed air through an air cooler that is submerged within the water of the second reservoir;

conveying the cooled water and the cooled compressed air to the nebulizers that are connected to the multiple chambers;

nebulizing the cooled water into cooled water particles; and introducing the cooled water particles into the multiple chambers via the cooled compressed air.

7. The method of claim 6, further comprising simultaneously introducing the heated and cooled water particles into the multiple chambers via the cooled and heated compressed air.

8. The method of claim 6, further comprising recirculating excess heated and cooled water from the nebulizers to the first and second reservoirs.

9. A process of cooling multiple chambers of a food preparation device, wherein the method comprises:

cooling water contained in a reservoir that is located outside of the multiple chambers of the food preparation device to reach a desired end point temperature that is between about 30 degrees Fahrenheit and 50 degrees Fahrenheit;

cooling compressed air through an air cooler that is submerged within the water of the reservoir;

conveying the cooling water and the cooled compressed air to nebulizers, which nebulizers are connected to the multiple chambers;

nebulizing the cooled water into cooled water particles; and introducing the cooled water particles into the multiple chambers via the cooled compressed air.

10. The method of claim 9, wherein the water contained in the reservoir is cooled utilizing a Peltier based cooler.

11. The method of claim 9, wherein the chambers are independently monitored and controlled.

12. The method of claim 9, further comprising recirculating excess cooled water from the nebulizers to the reservoir.

13. A food preparation device comprising:

multiple chambers located within the food preparation device, wherein each of the multiple chambers is connected to a respective nebulizer;

a reservoir of water located outside of the multiple chambers, wherein the reservoir of water comprises an air heater submerged within the water of the reservoir, wherein the air heater comprises a first end that connects to an air compressor and a second end that connects to the nebulizers connected to the multiple chambers;

a water heater comprising a first and second ends thereof, wherein the first and second ends of the first water heater are submerged within the water of the reservoir; and a pipeline, wherein one end of the pipeline is submerged within the water of the reservoir and an opposite end of the pipeline connects to the nebulizers connected to the multiple chambers.

14. The food preparation device of claim 13, wherein the water heater comprises a copper wire that passes through glass ceramic tubing, which copper wire and glass ceramic tubing are surrounded by a coiled copper tubing.

15. The food preparation device of claim 13, further comprising a secondary water heater located in the pipeline between the reservoir and the nebulizers connected to the multiple chambers.

16. The food preparation device of claim 13, wherein the air heater comprises a heat exchanger or coiled copped tubing.

17. The food preparation device of claim 13, further comprising at least one recirculation line from the nebulizers to the reservoir.

18. The food preparation device of claim 13, further comprising:

a second reservoir of water located outside of the multiple chambers;

an air cooler submerged within the water of the second reservoir, wherein the air cooler comprises a first and second end, wherein the first end connects to the air compressor and the second end connects to the nebulizers connected to the multiple chambers; and a second pipeline, wherein one end of the second pipeline is submerged within the water of the second reservoir and an opposite end connects to the nebulizers connected to the multiple chambers.

19. The food preparation device of claim 18, further comprising at least one recirculation line from the nebulizers to the second and first reservoirs.

20. The food preparation device of claim 18, wherein the second reservoir is positioned on top of a Peltier block or within a Peltier based cooler.

* * * * *